US007447455B2

(12) United States Patent
Kyung et al.

(10) Patent No.: US 7,447,455 B2
(45) Date of Patent: Nov. 4, 2008

(54) COLOR IMAGE FORMING APPARATUS AND MONO COLOR PRINTING METHOD THEREOF

(75) Inventors: Myung-ho Kyung, Suwon-si (KR); Yong-baek Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 175 days.

(21) Appl. No.: 11/390,171

(22) Filed: Mar. 28, 2006

(65) Prior Publication Data

US 2006/0269316 A1 Nov. 30, 2006

(30) Foreign Application Priority Data

May 26, 2005 (KR) ..... 10-2005-0044349

(51) Int. Cl.
*G03G 15/16* (2006.01)
*G03G 21/00* (2006.01)

(52) U.S. Cl. ..... 399/71; 399/66; 399/101

(58) Field of Classification Search ..... 399/71, 399/101, 66, 99, 160, 169, 343, 344, 345, 399/346, 82

See application file for complete search history.

(56) References Cited

U.S. PATENT DOCUMENTS 5,107,285 A * 4/1992 Hamada et al. ..... 399/169 X
5,732,310 A * 3/1998 Hiroshima et al. ..... 399/101
5,797,063 A * 8/1998 Umezawa et al. ..... 399/101 X
5,828,926 A 10/1998 Iwata et al.
6,032,006 A * 2/2000 Yanagida ..... 399/101
7,263,313 B2 * 8/2007 Kim et al. ..... 399/101 X

FOREIGN PATENT DOCUMENTS

| | | |
|---|---|---|
| JP | 09-101666 | 4/1997 |
| JP | 10-161426 | 6/1998 |
| JP | 2003-076103 | 3/2003 |
| JP | 2003-280318 | 10/2003 |
| KR | 1020010102829 | 11/2001 |

OTHER PUBLICATIONS

Machine translation of JP 2003-076103 A dated Mar. 13, 2008.*

* cited by examiner

*Primary Examiner*—Sophia S Chen
(74) *Attorney, Agent, or Firm*—Roylance, Abrams, Berdo & Goodman L.L.P.

(57) ABSTRACT

Disclosed are a color image forming apparatus for mono color printing and a method thereof. The apparatus includes photoconductors, a charger, a development unit for forming a developer image on each of the photoconductors, a transfer unit including an image transfer member for receiving the developer image from each of the photoconductors and a transfer voltage supply member for supplying a transfer bias voltage to the image transfer member, a first cleaning unit for cleaning the photoconductors, and a control unit for controlling the photoconductors, charger, development unit and transfer unit in a mono color printing mode to form a developer image on an image area of a selected photoconductor, to transfer the formed developer image to a non-image area of the image transfer member, and to divide the transferred developer image into portions and reverse-transfer the divided portions from the image transfer member to remaining photoconductors.

39 Claims, 11 Drawing Sheets

COLOR IMAGE FORMING APPARATUS AND MONO COLOR PRINTING METHOD THEREOF

CROSS-REFERENCE TO RELATED APPLICATION

This application claims the benefit under 35 U.S.C. §119(a) of Korean Patent Application No. 2005-44349 filed May 26, 2005, in the Korean Intellectual Property Office, the entire disclosure of which is hereby incorporated by reference.

BACKGROUND OF THE INVENTION

1. Field of the Invention

The present invention relates to an electro-photographic color image forming apparatus, such as a copier, a printer or a facsimile device. More particularly, the present invention relates to a color image forming apparatus having a mono color printing function for forming images using only a black color developer, and a method thereof.

2. Description of the Related Art

An electro-photographic color image forming apparatus forms color images on an image receiving medium, such as a paper. The color images are formed by forming electrostatic latent images on a photoconductor, such as a photoconductive belt or an organic photoconductive drum (OPC), developing the electrostatic latent image using developers of predetermined colors and transferring the developed image onto the image receiving medium.

FIG. 1 shows a conventional tandem type electro-photographic color image forming apparatus 1.

Referring to FIG. 1, a paper cassette 11 is disposed at a bottom portion of a main body M of the color image forming apparatus 1. The paper cassette 11 loads a stack of paper S, and a pick-up roller 12 picks up the paper S one by one. The picked-up paper S is conveyed to a regist roller 14.

The regist roller 14 conveys the paper to a conveyer belt 2. The conveyer belt 2 is rotated by a plurality of rotating rollers such as a driving roller 18, a first and a second tension rollers 20 and 21, and a passive roller 19. The conveyer belt 2 conveys the paper in an upward direction. A pressure roller 22 is disposed to face the passive roller 19 to pressurize the conveyer belt 2 to the passive roller 19.

A predetermined bias voltage is supplied to the pressure roller 22. When the pressure roller 22 pressurizes the paper S to the conveyer belt 2, the paper S adheres onto the conveyer belt 2 because of the supplied bias voltage.

As shown in FIG. 1, four photoconductors are vertically disposed to face the conveyer belt 2. That is, a yellow color photoconductor 1*y*, a magenta color photoconductor 1*m*, a cyan color photoconductor 1*c* and a black photoconductor 1*k* are vertically disposed from the bottom portion to the top portion in the image forming apparatus 1.

Chargers 3*y*, 3*m*, 3*c* and 3*k*, development units 5*y*, 5*m*, 5*c* and 5*k* and cleaning blades 6*y*, 6*m*, 6*c* and 6*k* are disposed around corresponding one of the photoconductors 1*y*, 1*m*, 1*c* and 1*k*, respectively. Transfer rollers 8*y*, 8*m*, 8*c* and 8*k* are disposed at an inner side of the conveyer belt 2.

A developer container of each development unit 5*y*, 5*m*, 5*c* or 5*k* contains a developer of corresponding color. Developer images of four colors are formed on corresponding photoconductors 1*y*, 1*m*, 1*c* and 1*k*, respectively through a sequence of image forming processes. Those formed developer images of four colors are transferred in order to the paper S while the paper S is being conveyed by the conveyer belt 2.

After forming the developer images on the paper S, the paper S is conveyed to a fuser 15 having a fusing roller 15*a* and a pressure roller 15*b*. The fusing roller 15*a* and the pressure roller 15*b* fix the developer images onto the paper S, permanently. Then, a discharge roller 16 outputs the paper S to an output tray 17 disposed at a top portion of the main body M.

The conventional color image forming apparatus generally includes functions for a full color printing mode and a mono color printing mode. In the full color printing mode, the conventional color image forming apparatus forms images using developers of yellow y, magenta m, cyan y and black k. On the contrary, the conventional color image forming apparatus forms images using only developer of black k in the mono color printing mode. Accordingly, a user often selects the mono color printing mode to reduce a maintenance cost of the developers and to print documents at high speed.

While the conventional color image forming apparatus is forming images on the paper in the mono color printing mode, developer images of yellow, magenta and cyan are not formed on the photoconductors 1*y*, 1*m* and 1*c*. However, the photoconductors 1*y*, 1*m* and 1*c* must be rotated to avoid the mechanical frictional force generated between the photoconductors 1*y*, 1*m* and 1*c* and the conveyer belt 2 because the transfer rollers 8*y*, 8*m* and 8*c* pressurize the conveyer belt 2 to the photoconductors 1*y*, 1*m* and 1*c* at a predetermined pressure to be in contact with the photoconductors 1*y*, 1*m* and 1*c*.

Since the photoconductors 1*y*, 1*m* and 1*c* are rotated, the cleaning blades 6*y*, 6*m* and 6*c* sweep the surfaces of the photoconductors 1*y*, 1*m* and 1*c* despite there not being developers applied on the surfaces of the photoconductor 1*y*, 1*m* and 1*c* in the mono color printing mode. If the cleaning blades 6*y*, 6*m* and 6*c* clean the photoconductors 1*y*, 1*m* and 1*c* when there is no remaining developer on the surface of the photoconductors 1*y*, 1*m* and 1*c*, the edges of the cleaning blades 6*y*, 6*m* and 6*c* are worn and damaged, and the surfaces of the photoconductors 1*y*, 1*m* and 1*c* are scratched because there is no developer applied on the surface of the photoconductor to work as a lubricant between the photoconductor and the cleaning blade. These scratched photoconductors 1*y*, 1*m* and 1*c* and the damaged cleaning blades 6*y*, 6*m* and 6*c* result in images of poor quality on the paper. Therefore, the image quality of the conventional image forming apparatus is degraded thereby.

Accordingly, there is a need for an improved color image forming apparatus having a mono color printing function for forming images using only a black color developer that prevents photoconductors and cleaning units from being damaged, and a method thereof.

SUMMARY OF THE INVENTION

Exemplary embodiments of the present invention address at least the above problems and/or disadvantages and provide at least the advantages described below. Accordingly, an aspect of the present invention is to provide a color image forming apparatus for preventing photoconductors and cleaning units thereof from being damaged when the photoconductors and the cleaning units thereof are not operated in a mono color printing mode, and a mono color printing method thereof.

According to one aspect of an exemplary embodiment of the present invention, there is provided a color image forming apparatus capable of performing a mono color printing mode for forming an image using a developer of one color, including: a plurality of photoconductors; a charger for charging each of the photoconductors; a development unit for forming a developer image on each of the photoconductors; a transfer unit for including an image transfer member receiving the developer image from each of the photoconductors and a transfer voltage supply member for supplying a transfer bias voltage to the image transfer member; a first cleaning unit for cleaning each of the photoconductors; and a control unit for controlling the photoconductors, charger, development unit and transfer unit in a mono color printing mode to form a developer image on an image area of a selected one of the plurality of photoconductors, to transfer the formed developer image to an non-image area of the image transfer member, and to divide the transferred developer image into portions and reverse-transfer the divided portions of the developer image from the image transfer member to remaining photoconductors.

When the divided portions of the transferred developer image come in contact with remaining photoconductors assigned to be reverse-transferred thereto, respectively, the control unit may control the transfer voltage supply member to supply a voltage of a certain level having a same polarity as a developer or may control the transfer voltage supply member not to supply any voltage to the image transfer member in contact with the remaining photoconductors.

Also, when the divided portions of the transferred developer image come in contact with remaining photoconductors assigned not to be reverse-transferred thereto, respectively, the control unit may control the transfer voltage supply member to supply a voltage of a certain level having a different polarity from a developer to the image transfer member in contact with the remaining photoconductors.

Furthermore, the control unit may control the charger not to supply a charge bias voltage to a first portion of an image area of each of the remaining photoconductors while the charger continuously supplies the charge bias voltage to each of the remaining photoconductors, where the first portion is a portion of the image area corresponding to the non-image area of the image transfer member. Herein, the color image forming apparatus may further include an erasing unit erasing an electric potential charged at the photoconductors, and the control unit may control the erasing unit to erase electric potential charged at the first portion on each of the remaining photoconductors. Herein, when the developer image formed on the first portion on each of the remaining photoconductors touches the non-image area of the image transfer member, the control unit may also control the transfer voltage supply member to supply a voltage of a certain level having a same polarity as a developer to the image transfer member in contact with each remaining photoconductor so as not to transfer the developer image formed on the first portion on each of the remaining photoconductors to the image transfer member.

Selectively, when a first portion of the image area of each remaining photoconductor touches the non-image area of the image transfer member after the control unit controls the charger not to supply a charge bias voltage to the first portion of each of the remaining photoconductors, the control unit may control the transfer voltage supply member to supply a voltage of a certain level having a difference polarity from a developer to the image transfer member in contact with each remaining photoconductor, where the first portion is a portion of the image area corresponding to the non-image area of the image transfer member. Herein, when developer images formed on the first portions of the remaining photoconductors touch the non-image area of the image transfer member after the developer images are formed on the first portions of the remaining photoconductors the control unit may control the transfer voltage supply member to supply a transfer bias voltage of a certain level having a same polarity as a developer to the image transfer member in contact with each remaining photoconductor.

The first cleaning unit may include a plurality of photoconductor cleaning blades disposed to touch each of the photoconductors.

The color image forming apparatus may further include a second cleaning unit cleaning a waster-developer and pollutant remaining on the image transfer member.

The second cleaning unit may configured as a belt cleaning blade having one end un-movably fixed to touch the image transfer member or a belt cleaning blade having one end pivotally fixed to touch the image transfer member or to be separated from the image transfer member.

When one end of the belt cleaning blade is pivotally fixed to touch the image transfer unit or to be separated from the image transfer unit, the second cleaning unit further may include a blade driving unit connected to the belt cleaning blade for separating the belt cleaning blade from the image transfer member when the non-image area of the image transfer member is passed in the mono color printing mode.

The blade driving unit may include a solenoid connected to the belt cleaning blade, and the solenoid may include a plunger connected to the belt cleaning blade; a coil shifting the plunger through generating a magnetic force when current is supplied; and an elastic spring pushing the plunger back to an original position when the coil does not generate the magnetic force.

The blade driving unit may include a cam touching the belt cleaning blade; and an elastic spring elastically pressurizing the belt cleaning blade to touch the cam.

According to another aspect of an exemplary embodiment of the present invention, there is provided a color image forming apparatus capable of performing a mono color printing mode for forming an image using a developer of one color, including: a plurality of photoconductors; a charger charging each of the photoconductors; a development unit forming a developer image on each of the photoconductors; a transfer unit including an image transfer member to receive the developer image formed on each of the photoconductors; a first cleaning unit cleaning each of the photoconductors; a second cleaning unit cleaning the image transfer member; and a control unit controlling the photoconductors, the charger and the transfer unit in a mono color printing mode to form developer images on an image area of one selected from the photoconductors and image areas of remaining photoconductors, to transfer the developer image formed on the selected photoconductor to an image receiving medium conveyed by the image transfer belt, and not to transfer the developer image formed on the image areas of the remaining photoconductors to the image receiving medium.

The control unit may control the charger not to supply a charge bias voltage to a first portion of the image area on each of the remaining photoconductors while continuously supplying the charge bias voltage to each of the remaining photoconductors, where the first portion is a portion of the image area corresponding to an non-image area of the image transfer member. Herein, the color image forming apparatus may further include an erasing unit erasing electric potential charged at the photoconductors, and the control unit may control the erasing unit to erase electric potential charged at the first portions of the remaining photoconductors. Herein, when developer images formed on the first portions of the remaining photoconductors touch the non-image area of the image transfer member, the control unit may also control a transfer voltage supply member to supply a voltage of a certain level having a same polarity as a developer to the image transfer member in contact with each remaining photoconductor.

Selectively, when the first portions of the remaining photoconductors touch the non-image area of the image transfer member after the control unit controls the charger not to supply a charge bias voltage to the first portions of the remaining photoconductors, the control unit may control the transfer voltage supply member to supply a voltage of a certain level having a different polarity from a developer to the image transfer member in contact with the remaining photoconductor. Herein, when the developer images formed on the first portions of the remaining photoconductors touch the non-image area of the image transfer member after the developer images are formed on the first portions of the remaining photoconductors, the control unit may also control the transfer voltage supply member to supply a voltage of a certain level having a same polarity as a developer to the image transfer member so as not to transfer developer images formed on the first portions of the remaining photoconductors to the image transfer member in contact with the remaining photoconductor.

According to still another aspect of an exemplary embodiment of the present invention, there is provided a color image forming apparatus capable of performing a mono color printing mode for forming an image using a developer of one color, including: a plurality of photoconductors; a charger charging each of the photoconductors; a development unit developing a developer image on each of the photoconductors; a transfer unit including an image transfer member to receive the developer image formed on each of the photoconductors; a first cleaning unit cleaning each of the photoconductors; a second cleaning unit disposed to touch the image transfer member or to be separated from the image transfer member for cleaning the image transfer member; and a driving unit connected to the second cleaning unit for separating the second cleaning unit from the image transfer member when the second cleaning unit is passed an non-image area of the image transfer member in the mono color printing mode.

The second cleaning unit may include a belt cleaning blade having one end pivotally fixed.

The driving unit includes a solenoid connected to the belt cleaning blade. The solenoid may include a plunger connected to the belt cleaning blade; a coil shifting the plunger through generating a magnetic force when a current is supplied; and an elastic spring returning the plunger to an original position when the coil does not generate the magnetic force.

Selectively, the driving unit may include a cam touching the belt cleaning blade; and an elastic spring elastically pressurizing the belt cleaning blade to be in contact with the cam.

According to the further still another aspect of an exemplary embodiment of the present invention, there is provided a mono color printing method of a color image forming apparatus forming an image using a developer of one color, the mono color printing method including: determining whether a current printing mode of the color image forming apparatus is a mono color printing mode or not; forming a developer image on one photoconductor that performs an image forming process in the mono color printing mode if the current printing mode is the mono color printing mode; transferring the developer image formed on the one photoconductor to an image transfer member; dividing the developer image transferred on the image transfer member into portions and reverse-transferring the divided portions of the transferred developer image from the image transfer member to remaining photoconductors which do not perform the image forming process in the mono color printing mode; and cleaning the reverse-transferred developer image on each of the remaining photoconductors The forming of the developer image may include forming a developer image on a second portion of an image area on the one photoconductor, where the second portion is a portion of the image area corresponding to an image area of the image transfer member conveying the image receiving medium; and forming a developer image on a first portion of the image area of the mono color photoconductor, where the first portion is a portion of the image area corresponding to a non-image area of the image transfer member.

The transferring of the developer image to the image transfer member may include: transferring the developer image formed on the second portion of the image area on the one photoconductor to the image receiving medium conveyed by the image transfer member; and transferring the developer image formed on the first portion of the image area on the one photoconductor to the non-image area of the image transfer member.

The dividing and reveres-transferring of the developer image may include: supplying a voltage of a certain level having a same polarity of a developer or not supplying any voltages to the image transfer member in contact with remaining photoconductors when the divided portions of the developer image transferred on the non-image area of the image transfer member touch the remaining photoconductor assigned to be reverse-transferred thereto, respectively; and supplying a voltage of a certain level having a polarity different from a developer to the image transfer member in contact with remaining photoconductors when the divided portions of the developer image transferred on the non-image area of the image transfer member touch the remaining photoconductors assigned not to be reverse-transferred thereto, respectively.

The mono color printing method may further include: forming the developer image on each of the remaining photoconductors; and controlling not to transfer the developer image formed on each of the remaining photoconductors to the image transfer member.

The forming of the developer image on each of the remaining photoconductors may include controlling not to supply a charge bias voltage to first portions of the image areas of the remaining photoconductors while continuously supplying the charge bias voltage to each of the remaining photoconductors, where the first portion is a portion of the image areas in the remaining photoconductor corresponding to the non-image area of the image transfer member. Herein, the developer image on each of the remaining photoconductors may further include erasing electric potential charged at the first portion of the image area in each of the remaining photoconductors.

Selectively, the forming of the developer image on each of the remaining photoconductors may include supplying a voltage of a certain level having a polarity different from a developer to the image transfer member in contact with the remaining photoconductors when the first portions of the remaining photoconductors touch to the image transfer member after not supplying the charge bias voltage to the first portions of the remaining photoconductors.

The controlling of not to transfer the developer image may include supplying a voltage of a certain level having a same polarity as a developer to the image transfer member not to transfer the developer image to the image transfer member in contact with the remaining photoconductors when the developer image formed on the first portions of the remaining photoconductors touch the non-image area of the image transfer member.

The mono color printing method according to an exemplary embodiment of the present invention may further include cleaning the image transfer member to remove developer image and pollutant remaining on the image transfer member.

Selectively, the mono color printing method according to an exemplary embodiment of the present invention may further include controlling not to clean the image transfer member when the non-image area of the image transfer member is passed; and cleaning the image transfer member to remove a developer image and pollutant remaining on the image transfer member after an image forming operation is terminated.

According to even further another aspect of an exemplary embodiment of the present invention, there is provided a mono color printing method of a color image forming apparatus for forming an image using a developer of one color including: determining whether a current printing mode of the color image forming apparatus is a mono color printing mode or not; forming a developer image on one photoconductor that performs an image forming process in the mono color printing mode if the current printing mode is the mono color printing mode; transferring the developer image formed on the one photoconductor to an image transfer member; forming a developer image on remaining photoconductors that do not perform the image forming process in the mono color printing mode; controlling not to transfer the developer image formed on each of the remaining photoconductors to the image transfer member; and cleaning the developer image remaining on the one photoconductor and the developer image formed on each of the remaining photoconductors after transferring the developer image to the image transfer member.

The forming of the developer image on each of the remaining photoconductors may include controlling not to supply a charge bias voltage to a first portion of an image area in each of the remaining photoconductors while continuously supplying the charge bias voltage to each of the remaining photoconductors, where the first potion is a portion of the image area corresponding to a non-image area of the image transfer member. Herein, the forming of the developer image on each of the remaining photoconductors may further include erasing electric potential charged at the first portion of the image area in each of the color photoconductors.

The forming of the developer image on each of the remaining photoconductors may include supplying a voltage of a certain level having a polarity different from a developer to the image transfer member in contact with the remaining photoconductors when a first portion of an image area in each of the remaining photoconductors touches the image transfer member after controlling not to supply the charge bias voltage to the first portion of the image area in each of the color photoconductors, where the first potion is a portion of the image area corresponding to a non-image area of the image transfer member.

The controlling of not to transfer may include supplying a voltage of a certain level having a same polarity as a developer to the image transfer member in contact with the remaining photoconductors when the developer image formed on a portion of an image area in each of the remaining photoconductors touches the non-image area of the image transfer member so as not to transfer the developer image to the image transfer member.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Embodiment 1

Figure 2:
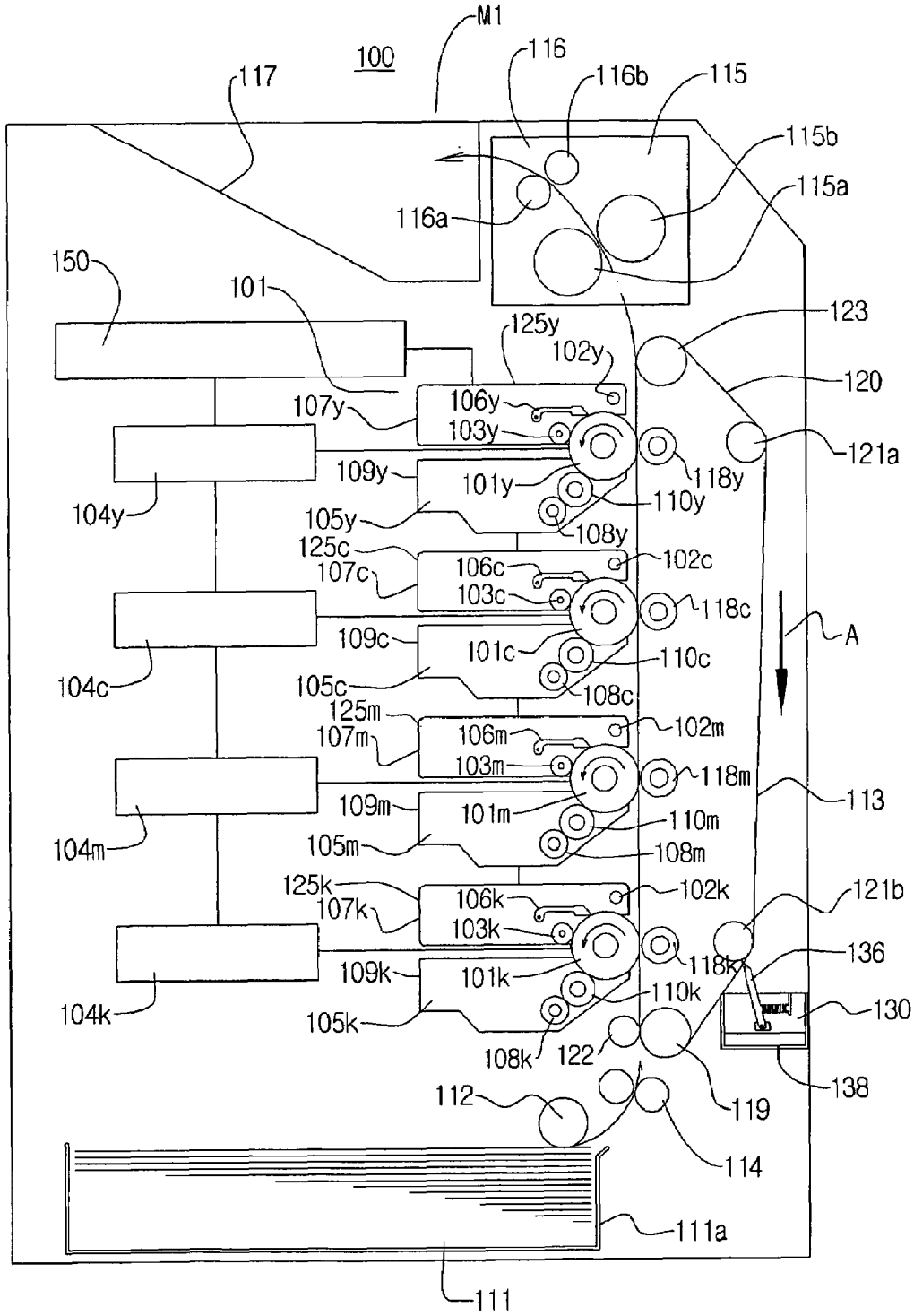
FIG. 2 is a schematic view of a tandem color image forming apparatus according to a first, a second and a third embodiments of the present invention.

FIG. 2 shows a tandem color image forming apparatus 100 according to a first embodiment of the present invention.

Referring to FIG. 2, the tandem color image forming apparatus 100 includes a feeding unit 111, an image forming unit

101, a transferring unit 120, a fusing unit 115, a paper output unit 116, a cleaning unit 130 and a control unit 150.

The feeding unit 111 feeds an image receiving medium S such as a paper. The feeding unit 111 includes a paper cassette 111*a*, a pickup roller 112 and a regist roller 114. The paper cassette 111*a* is disposed at a bottom portion of a main body M1 of the tandem color image forming apparatus 100 and loads the image receiving medium S. The loaded image receiving medium S in the paper cassette 111*a* is picked up by the pickup roller 112 and conveyed to the regist roller 114.

The image forming unit 101 is disposed above the feeding unit 111 and forms developer images of predetermined colors, such as black k, magenta m, cyan c and yellow y, on the image receiving medium S.

The image forming unit 101 includes a first, second, third and fourth photoconductors 101*k*, 101*m*, 101*c* and 101*y*. These photoconductors 101*k*, 101*m*, 101*c* and 101*y* are vertically disposed to face an image transfer belt 113 of the transferring unit 120. That is, the first, second, third and fourth photoconductors 101*k*, 101*m*, 101*c* and 101*y* are disposed vertically in order from the bottom to the top of FIG. 2. Each of the first, second, third and fourth photoconductors 101*k*, 101*m*, 101*c* and 101*y* includes an organic photoconductive (OPC) drum having a circumference surface coated with an organic photoconductive layer and has both ends rotatably supported by flanges. The first, second, third and fourth photoconductors 101*k*, 101*m*, 101*c* and 101*y* are disposed to be in contact with an image transfer belt 113 to form a nip and a first, second, third and fourth transfer rollers 118*k*, 118*m*, 118*c* and 118*y* of the transferring unit 120 pressurizes the image transfer belt 113 to those photoconductors 101*k*, 101*m*, 101*c* and 101*y* with a predetermined pressure. Also, the first, second, third and fourth photoconductors 101*k*, 101*m*, 101*c* and 101*y* are rotated in a counterclockwise direction by a gear train (not shown) that receives a driving force from a driving motor (not shown).

Around the first, second, third and fourth photoconductors 101*k*, 101*m*, 101*c* and 101*y*, a first, second, third and fourth chargers 103*k*, 103*m*, 103*c* and 103*y*; a first, second, third and fourth laser scanning units 104*k*, 104*m*, 104*c* and 104*y*; a first, second, third and fourth development units 105*k*, 105*m*, 105*c* and 105*y*; a first, second, third and fourth erasing units 102*k*, 102*m*, 102*c* and 102*y*; and a first, second, third and fourth cleaning units 107*k*, 107*m*, 107*c* and 107*y* are disposed, respectively.

Each of the first, second, third and fourth chargers 103*k*, 103*m*, 103*c* and 103*y* are a conductive roller. The first, second, third and fourth chargers 103*k*, 103*m*, 103*c* and 103*y* are in contact with the surfaces of the first, second, third and fourth photoconductors 101*k*, 101*m*, 101*c* and 101*y*. The controller 150 controls a charging bias voltage supply unit (not shown) to supply a predetermined charging bias voltage to the first, second, third and fourth chargers 103*k*, 103*m*, 103*c* and 103*y*. As a result, charged electric potential of predetermined polarities are formed on the surfaces of the first, second, third and fourth photoconductor 101*k*, 101 *m*, 101*c* and 101*y*, respectively. For example, when the developer has a negative polarity (−), a charged electric potential of −600V is formed.

The first, second, third and fourth laser scanning units 104*k*, 104*m*, 104*c* and 104*y* form electrostatic latent images having lower electric potential than the charged electric potential, −50V for example, by radiating a laser beam on the charged surfaces of the first, second, third and fourth photoconductors 101*k*, 101*m*, 101*c* and 101*y* according to an image signal inputted from a computer or a scanner. Since these laser scanning units 104*k*, 104*m*, 104*c* and 104*y* are well known to those skilled in the art, detailed descriptions thereof are omitted.

The first, second, third and fourth development units 105*k*, 105*m*, 105*c* and 105*y* adhere developers of corresponding colors onto the electrostatic latent image formed on the first, second, third and fourth photoconductors so as to develop the electrostatic latent image into a visual developer image. Those development units 105*k*, 105*m*, 105*c* and 105*y* include: a first, second, third and fourth developer containers 109*k*, 109*m*, 109*c* and 109*y*; a first, second, third and fourth developing rollers 110*k*, 110*m*, 110*c* and 110*y*; and a first, second, third and fourth developer supplying rollers 108*k*, 108*m*, 108*c*, 108*y*.

Each of the first, second, third and fourth developer containers 109*k*, 109*m*, 109*c* and 109*y* contain developers of black k, yellow y, magenta m and cyan c having a predetermined polarity, for example, a negative polarity.

The first, second, third and the fourth developer rollers 110*k*, 110*m*, 110*c* and 110*y* adhere the developers on the electrostatic latent images formed on the first, second third and fourth photoconductors 101*k*, 101*m*, 101*c* and 101*y* while being rotated with the first, second, third and fourth photoconductors 101*k*, 101*m*, 101*c* and 101*y* so as to develop the electrostatic latent images. Accordingly, the first, second, third and fourth developer rollers 110*k*, 110*m*, 110*c* and 110*y* are disposed closely to the surfaces of the first, second, third and fourth photoconductors 101*k*, 101*m*, 101*c* and 101*y* and are rotated in a clockwise direction by a driving force transferring gear (not shown) connected to a gear train driving the photoconductors. The control unit 150 controls a developing bias voltage supply unit (not shown) to supply a developing bias voltage of a predetermined level, such as about −250V, which is about 100V to 400V lower than the developer supplying roller 108*k*, 108*m*, 108*c* and 108*y*, to the first, second, third and fourth developer rollers 110*k*, 110*m*, 110*c* and 110*y*.

The first, second, third and fourth developer supplying rollers 108*k*, 108*m*, 108*c* and 108*y* supply developers to the first, second, third and fourth developer rollers 110*k*, 110*m*, 110*c* and 110*y* using an electric potential difference from the first, second, third and fourth developer rollers 110*k*, 110*m*, 110*c* and 110*y*. Accordingly, the first, second, third and fourth developer supplying rollers 108*k*, 108*m*, 108*c* and 108*y* are disposed to be in contact with one side of the bottom surface of the first, second, third and fourth developer roller 110*k*, 110*m*, 110*c* and 110*y* so as to form a nip. The developers of black k, yellow y, magenta m and cyan c are conveyed by an agitator (not shown) to spaces formed between the first, second, third and fourth developer supplying rollers 108*k*, 108*m*, 108*c* and 108*y* and the first, second, third and fourth developer rollers 110*k*, 110*m*, 110*c* and 110*y*.

The control unit 150 controls a developer supplying bias voltage supply unit (not shown) to supply a developer supplying bias voltage, such as −500V, which is 100V to 400V higher than the first, second, third and fourth developer rollers 110*k*, 110*m*, 110*c* and 110*y*, to the first, second, third and fourth developer supplying rollers 108*k*, 108*m*, 108*c* and 108*y*. Therefore, the developers, which are conveyed to the spaces formed between the developer supplying rollers 108*k*, 108*m*, 108*c* and 108*y* and the developer rollers 110*k*, 110*m*, 110*c* and 110*y*, have a comparatively higher electric potential by receiving the charge from the developer supplying rollers 108*k*, 108*m*, 108*c* and 108*y*. As a result, the conveyed developers are adhered to the first, second, third and fourth developer rollers 110*k*, 110*m*, 110*c* and 110*y* having a comparatively lower electric potential, and is continuously conveyed to the nip between the first, second, third and fourth developer supplying rollers 108*k*, 108*m*, 108*c* and 108*y* and the first, second, third and fourth developer rollers 110*k*, 110*m*, 110*c* and 110*y*.

The first, second, third and fourth erasing units 102*k*, 102*m*, 102*c* and 102*y* include erase lamps to eliminate charged electric potential on the surfaces of the first, second, third and fourth photoconductors 101*k*, 101*m*, 101*c* and 101*y*.

The first, second, third, and fourth cleaning units 107*k*, 107*m*, 107*c* and 107*y* cleans off the developer that remains on the surfaces of the photoconductors 101*k*, 101*m*, 101*c* and 101*y* after the photoconductors 101*k*, 101*m*, 101*c* and 101*y* are rotated a rotation cycle time. The first, second, third, and fourth cleaning units 107*k*, 107*m*, 107*c* and 107*y* include a first, second, third and a fourth photoconductor cleaning blades 106*k*, 106*m*, 106*c* and 106*y* and a first, second, third and fourth photoconductor-waste developer collectors 125*k*, 125*m*, 125*c* and 125*y*.

The first, second, third, and fourth photoconductor cleaning blades 106*k*, 106*m*, 106*c* and 106*y* are disposed to be in contact with the first, second, third, and fourth photoconductors 101*k*, 101*m*, 101*c* and 101*y* while being pressurized at a predetermined pressure.

The first, second, third and fourth photoconductor-waste developer collectors store the waste developer cleaned and collected from the first, second, third and fourth photoconductors 101*k*, 101*m*, 101*c* and 101*y* by the first, second, third and fourth photoconductor cleaning blades 106*k*, 106*m*, 106*c* and 106*y*. The first, second, third and fourth chargers 103*k*, 103*m*, 103*c* and 103*y* are divided from the first, second, third and fourth erasing units 102*k*, 102*m*, 102*c* and 102*y* by a partition wall (not shown).

The photoconductors 101*k*, 101*m*, 101*c* and 101*y*, the chargers 103*k*, 103*m*, 103*c* and 103*y*, the laser scanning units 104*k*, 104*m*, 104*c* and 104*y*, the developers 105*k*, 105*m*, 105*c* and 105*y*, the erasers 102*k*, 102*m*, 102*c* and 102*y* and the cleaning units 107*k*, 107*m*, 107*c* and 107*y* are integrally configured in a process cartridge and the process cartridge is detachably disposed in the main body M1 of the color image forming apparatus.

The transfer unit 120 transfers the developer images formed on the first, second, third and fourth photoconductor 101*k*, 101*m*, 101*c* and 101*y* on the image receiving medium S. The transfer unit 120 includes an image transfer belt 113 and a first, second, third and fourth transfer rollers 118*k*, 118*m*, 118*c* and 118*y*.

The image transfer belt 113 conveys the image receiving medium S. The image transfer belt 113 is disposed so as to rotate in a direction of conveying the image receiving medium, for example, the direction A shown in FIG. 2, by a plurality of rotation rollers including a driving roller 123, and a first and second tension rollers 121*a* and 121*b*.

The surface of the image transfer belt 113 is coated by an organic photoconductive layer to receive the developer images formed on the first, second, third and fourth photoconductors 101*k*, 101*m*, 101*c* and 101*y*.

A pressure roller 122 is disposed to face a passive roller 119 to pressurize the image transfer belt 113.

When the image receiving medium S is conveyed to the pressure roller 122 by the regist roller 114, the pressure roller 112 receives a bias voltage of a predetermined level and pressurizes the image receiving medium S to the image transfer belt 113. As a result, the image receiving medium S adheres to the image transfer belt 113 due to the bias voltage.

The first, second, third and fourth transfer rollers 118*k*, 118*m*, 118*c* and 118*y* transfer a transfer-bias voltage to the image transfer belt 113. Each of the transfer rollers 118*k*, 118*m*, 118*c* and 118*y* is disposed at the inner side of the image transfer belt 113 to pressurize the image transfer belt 113 to a corresponding one of the photoconductors 101*k*, 101*m*, 101*c* and 101*y* with a predetermined pressure. A transfer-bias supplying unit (not shown) supplies the transfer-bias voltage of a predetermined level to the transfer rollers 118*k*, 118*m*, 118*c* and 118*y* in response to the control unit 150.

The fusing unit 115 fixes the developer images 132 on the image receiving medium S. In order to fix the developer images 132, the fusing unit 115 includes a heating roller 115*a* and a pressure roller 115*b*. The heating roller 115*a* includes a heater (not shown) to heat the developer images 132 on the image receiving medium S with high temperature in order to fuse the developer images 132 on the image receiving medium S. The pressure roller 115*b* is disposed to be supported by an elastic member (not shown) to pressurize the image receiving medium S to the heating roller 115*a*.

The paper output unit 116 outputs the image receiving medium S to an output tray 117 after fixing the developer images 132 on the image receiving medium S. The paper output unit 116 includes an output roller 116*a* and a backup roller 116*b*.

The cleaning unit 130 is disposed under the image transfer belt 113 and includes a belt-cleaning blade 136 and a belt-waste developer collector 138. The belt-cleaning blade 136 cleans and collects the waste developer that remains on the surface of the image transfer belt 113 after the image transfer belt 113 is rotated one rotation cycle. The belt-waste developer collector 138 receives and stores the collected waste developer.

The control unit 150 is disposed at an upper portion of the main body M1 and is configured with a circuit board having a microprocessor electrically connected to each constitutional elements of the image forming apparatus 100.

In a mono color printing mode, the control unit 150 controls each of the image forming units 101 to form two developer images 132 and 133 on an image region of the first photoconductor 101*k* that performs an image forming process using the black color developer as shown in FIGS. 6A through 6D. The developer image 132 is formed corresponding to image signals inputted from a computer or a scanner. The developer image 133, which has a predetermined pattern such as a plurality of horizontal lines, is lengthily formed in a widthwise direction of the image forming belt 113, which is a lengthwise direction of the first photoconductor 101*k* for lubrication of the photoconductor-cleaning blade. In the mono color printing mode, the control unit 150 also controls a transfer-bias voltage supply unit (not shown) to supply the transfer-bias voltage to the first transfer roller 118*k* of the transfer unit 120 so that the developer images 132 and 133 formed on the image region of the first photoconductor 101*k* are transferred to an image forming area IA and to a non-image area UIA of the image transfer belt 113, respectively while the image transfer belt 113 is conveying the image receiving mediums S. The non-image area UIA is an area of the image transfer belt 113 between two consecutive image receiving mediums S which are conveyed by the image transfer belt 113.

For example, when the developer images 132 and 133 formed on the first photoconductor 101*k* are transferred to the image transfer belt 113, the control unit 150 controls so as to supply a voltage, to the first transfer roller 118*k*, having an opposite polarity as compared to a current polarity of the developer. For example, if the developer has a negative polarity (−), the voltage of positive polarity, such as +1V to +1.2V, is supplied to the first transfer roller 118*k*. The supplied voltage of positive polarity is transferred to the image receiving medium S through the image transfer belt 113 to form an electric field which pulls the developer image having a negative polarity. As a result, the developer images 132 and 133 are transferred to the image receiving medium S and the non-image area UIA of the image transfer belt 113 due to the electric field.

Furthermore, the control unit 150 controls the transfer-bias voltage supply unit to supply a transfer-bias voltage to the second, third and fourth transfer rollers 118*m*, 118*c* and 118*y* to divide the developer image 133 transferred onto the non-image area UIA of the image transfer belt 133 into portions and to reverse-transfer the portions of the developer image 133 to the second, third and fourth photoconductors 101*m*, 101*c* and 101*y* which are not operated in the mono color printing mode. Accordingly, the lubrication between the second, third and fourth photoconductor-cleaning blades 106*m*, 106*c* and 106*y* and the second, third and fourth photoconductors 101*m*, 101*c* and 101*y* is improved.

In more specific, when a first, a second and a third portions 133*a*, 133*b* and 133*c* of the developer image 133 transferred onto the non-image area UIA are respectively reverse-transferred to the second, the third and the fourth photoconductors 101*m*, 101*c* and 101*k* in the mono color printing mode, the control unit 150 controls to interrupt voltage supply or to supply voltage having a polarity identical to the developer, for example, −1V to −1.2V, to the second, the third and the fourth transfer rollers 118*m*, 118*c* and 118*y*. As shown in FIG. 6B through 6D, if the −1V to −1.2V is supplied, the voltage of negative polarity is transferred to the non-image area UIA of the image transfer belt 113 so as to form an electric field pushing the developer image of the negative polarity. As a result, the first, second and third portions 133*a*, 133*b*, 133*c* of the developer image 133 having the negative polarity transferred onto the non-image area UIA of the image transfer belt 113 are moved to the second, third and fourth photoconductors 101*m*, 101*c* and 101*y* by the electric field. Also, if the voltage is not supplied, the first, second and third portions 133*a*, 133*b* and 133*c* of the developer image 133 are pressurized to the second, third and fourth photoconductors 101*m*, 101*c* and 101*y* by the second, third and fourth transfer rollers 118*m*, 118*c* and 118*y* while the first, second and third portions 133*a*, 133*b* and 133*c* of the developer image 133 are passing the nip between the second, third and fourth photoconductors 101*m*, 101*c* and 101*y* and the second, third and fourth transfer rollers 118*m*, 118*c* and 118*y*. As a result, the first, second and third portions 133*a*, 133*b* and 133*c* of the developer image 133 are partially moved to the image regions of the second, third and fourth photoconductors 101*m*, 101*c* and 101*y*. Those moved portions 133*a*, 133*b* and 133*c* of the developer image 133 are cleaned by the second, third and fourth photoconductor cleaning blades 106*m*, 106*c* and 106*y* and collected by the second, third and fourth photoconductor waste developer collectors 125*m*, 125*c* and 125*y* when the second, third and fourth photoconductors 101*m*, 101*c* and 101*y* are rotated in a counterclockwise direction by a gear train receiving the driving force from the driving motor. Thus, the development of the developer image 133 protects the second, third and fourth photoconductor cleaning blades 106*m*, 106*c* and 106*y* from being damaged or worn which may be caused when the photoconductor cleaning blades 106*m*, 106*c* and 106*y* touch the photoconductors without the remaining developer. Also, the surfaces of the second, third and fourth photoconductors 101*m*, 101*c* and 101*y* are protected from being damaged by the second, third and fourth photoconductor cleaning blades 106*m*, 106*c* and 106*y*.

Hereinafter, a mono color printing method of a tandem color image forming apparatus 100 according to a first embodiment of the present invention, constructed as described above, will be described with reference to FIG. 7.

At first, if a printing command is input through a computer or a control panel in operation S1, the control unit 150 determines whether or not a printing mode of the printing command is a mono color printing mode for forming images using only the black developer in operation S2.

If the mono color printing mode is selected in the operation S2, the control unit 150 controls the image forming unit 101 including the first charger 103*k*, first laser scanning unit 104*k* and first development unit 105*k* to perform an image forming process that forms developer images 132 of black color on an image region of the first photoconductor 101*k* according to data of a first page in operation S3.

The first developer supplying roller 108*k* transfers the black developer having a predetermined polarity, for example a negative polarity, from the first developer container 109*k* to the nip between the first developer supplying roller 108*k* and the developer roller 110*k*. The black developer that has been moved is transferred to the first developer roller 110*k* by an electric potential difference between the first developer supplying roller 108*k* and the first developer roller 110*k*. For example, the first developer supplying roller 108*k* receives a developer-supplying bias voltage, such as −500V, and the first developer roller 110*k* receives a developing bias voltage, such as −250V, from the corresponding bias voltage supply unit. Since the first developer roller 110*k* is continuously rotated, the developer layer of a predetermined thickness formed on the first developer roller 110*k* is transferred to a developing region that forms a nip touching the first photoconductor 101*k*. Meanwhile, the first photoconductor 101*k* charged with high voltage, such as about −600V, by the first charger 103*k* is selectively exposed by the laser beam radiated from the first laser scanning unit 104*k* according to an image signal to form the developer image according to data of a first page inputted through a computer or a scanner. Due to the exposing, a predetermined region of the first photoconductor 101*k* is attenuated so as to have low electric potential, such as −50V. That is, a low electric potential region is formed on the surface of the first photoconductor 101*k*. Accordingly, an electrostatic latent image including the low potential region of −50V and the high potential region of −600V is formed. Then, when the developer layer formed on the first developer roller 110*k* touches the corresponding developing region of the first photoconductor 101*k*, the electric potential difference of −200V is formed between the low potential region of the electrostatic latent image, which is formed on the surface of the first photoconductor 101*k*, and the first developer roller 110*k*. Accordingly, the low potential region of the electrostatic latent image comes to an electric potential of positive polarity (+) relative to that of the first developer roller 110*k*. Due to the electric field generated by the electric potential difference, the developer having the negative polarity (−) is transferred to the low potential region of the electrostatic latent image of the first photoconductor 101*k*. Therefore, the electrostatic latent image of the first photoconductor 101*k* is developed as the developer image 132 of the black color according to the data of the first page.

Meanwhile, the image receiving medium S loaded in the paper cassette 111*a* is picked up by the pickup roller 112 and conveyed to the pressure roller 122 by the regist roller 114 at a predetermined time. Then, the image receiving medium S is conveyed to the nip between the image transfer belt 113 and the first photoconductor 101*k* by the pressure roller 122.

Figure 6A:
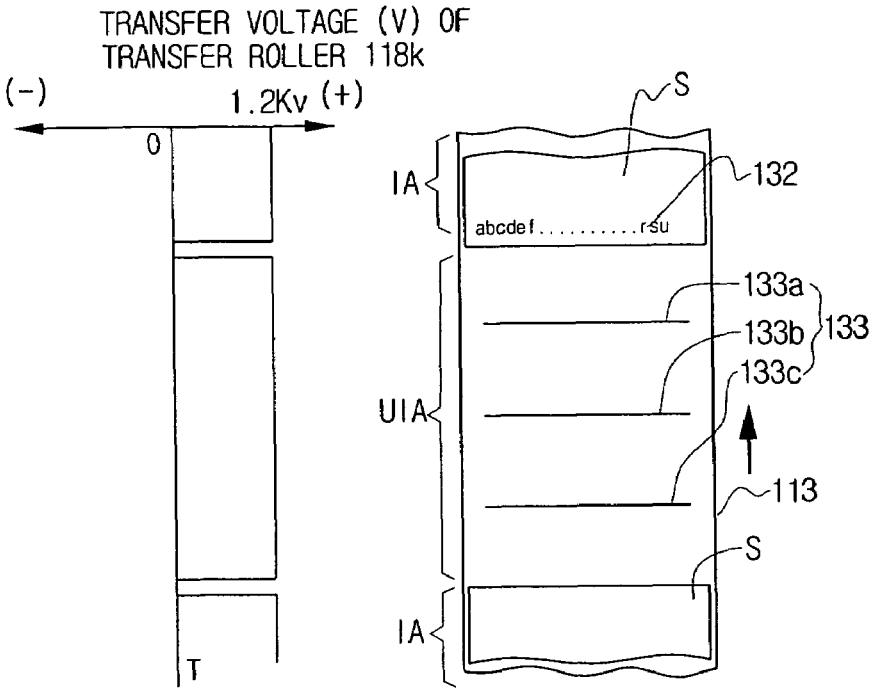
FIGS. 6A through 6D are schematic views for describing reverse-transferring of a developer image from an image transfer belt to a second, a third and a fourth photoconductors of the tandem color image forming apparatus shown in FIG. 2.
Figure 6B:
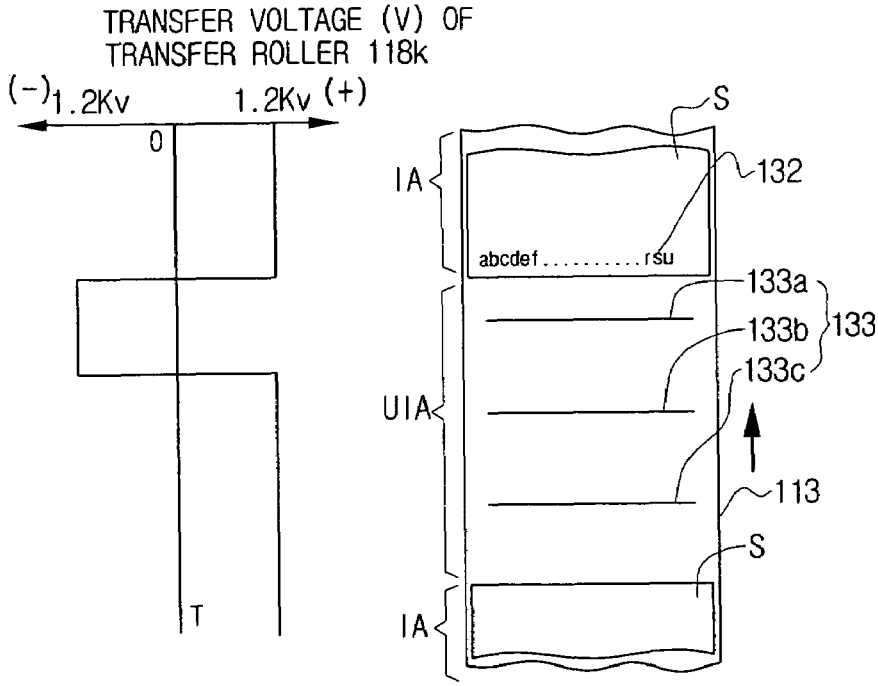
Figure 6C:
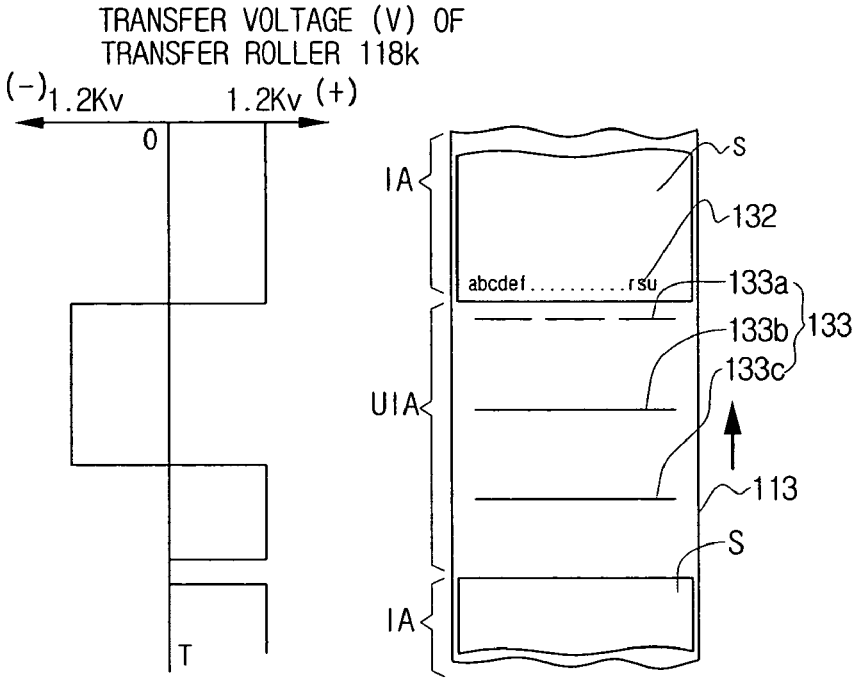
Figure 6D:
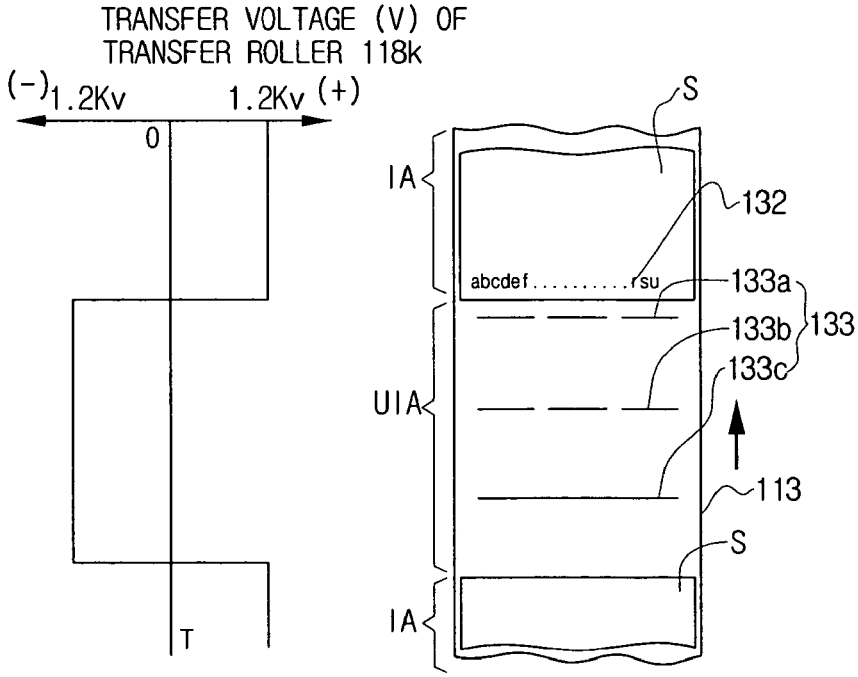

As shown in FIG. 6A, when the first photoconductor 101*k* is rotated in the counterclockwise direction by the gear train by receiving the force from the driving motor, the black developer image 132 of the first page's data, which is formed on the image region of the first photoconductor 101*k* corresponding to the image forming area IA of the image transfer belt 113, is transferred to the image forming medium S by the transfer bias voltage, such as +1 to 1.2 KV, that is supplied to the first transfer roller 118*k* from the transfer bias voltage supply unit in response to the control unit 150 in operation S4. The control unit 150 controls a timing of a starting to form the black developer image 132 on the image region of the first photoconductor 101*k* using a paper detecting sensor (not shown). Herein, the paper detecting sensor is disposed at a proper position such as between the regist roller 114 and the pressure roller 122 and detects a top edge and a bottom edge of the image receiving medium S.

After the developer image 132 is transferred from the first photoconductor 101*k* to the image receiving medium S, the pollutant and the waste developer remaining on the first photoconductor 101*k* is cleaned by the first photoconductor cleaning blade 106*k* and collected by the first photoconductor waste developer collector 125*k* while the first photoconductor 101*k* is continuously rotated in operation S5.

The image receiving medium S on which the black developer image 132 is transferred, is conveyed to the fusing unit 115 and the fusing unit 115 having the fusing roller 115*a* and the pressure roller 115*b* permanently fixes the developer image 132 on the image receiving medium S. Then, the paper output unit 116 having the output roller 116*a* and the backup roller 116*b* outputs the image receiving medium S to the output tray 117 in operation S6.

Then, the control unit 150 controls the first image forming unit 101 including the first charger 103*k*, first laser scanning unit 104*k* and first development unit 105*k* as like in the operation S3 to form the developer image 133 on the non-image area UIA of the image transfer belt 113, which is a portion of the image transfer belt 113 between the image receiving medium S of the first page and the image receiving medium S of the following page, for the lubrication of the photoconductor cleaning blade in operation S7. As shown in FIG. 6A, the developer image 133 is a plurality of horizontal lines lengthily formed in a widthwise direction of the image forming belt 133, which is a lengthwise direction of the first photoconductor 101*k*.

The black developer image 133 formed on the image region of the first photoconductor 101*k* is transferred to the non-image area UIA of the image transfer belt 113 in operation S8 as shown in FIG. 6A.

Since the driving roller 123, the passive roller 119 and the first and the second tension rollers 121*a* and 121*b* continuously rotates the image transfer belt 113 in a direction A of FIG. 2, the black developer image 133 transferred on the non-image area UIA is conveyed to the nip between the second photoconductor 101*m* and the image transfer belt 113.

When the developer image 133 reaches the nip between the second photoconductor 101*m* and the image transfer belt 113, the control unit 150 controls the transfer bias voltage supply unit to interrupt a voltage supply or to supply a transfer bias voltage having the same polarity as the developer, for example, −1 KV to −1.2 KV, to the second transfer roller 118*m* while the first portion 133*a* of the developer images 133 is passing the nip between the second photoconductor 101*m* and the image transfer belt 113. As a result, the first portion 133*a* of the developer image 133 formed on the non-image area UIA is transferred to the second photoconductor 101*m* by the electric field formed by the transfer bias voltage, such as −1V to −1.2 KV, or transferred to the second photoconductor 101*m* by being pressurized by the second transfer roller 118*m* in operation S9.

Figure 1:
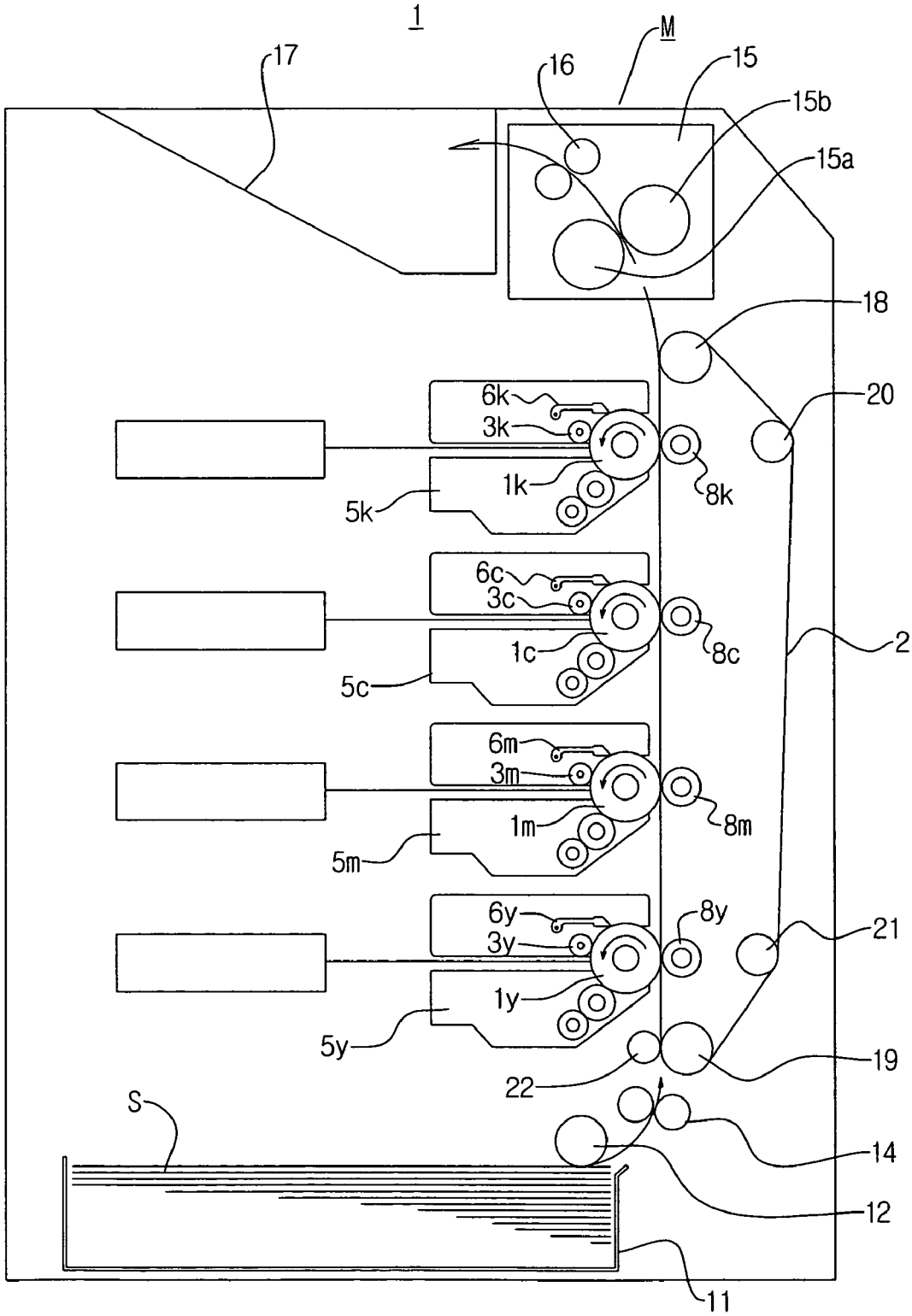
FIG. 1 (PRIOR ART)
FIG. 1 is a schematic view of a conventional tandem type electro-photographic color image forming apparatus.

The first portion 133*a* transferred on the second photoconductor 101*m* is cleaned and removed by the second photoconductor cleaning blade 106*m* and collected and stored in the second photoconductor waste developer collector 125*m* in operation S10. As shown in FIG. 1, the cleaning blade is in contact with the photoconductor without any developer being on the photoconductor in the mono color printing mode of the conventional image forming apparatus. So, the edges of the cleaning blade and the surface of the photoconductor are easily damaged, scratched and worn. However, developer of the developer image 133 protects not only the surface of the photoconductor but also the cleaning blade according to an exemplary embodiment of the present invention as described above. Therefore, the second photoconductor cleaning blade 106*m* is not worn or damaged and the surface of the photoconductor is not scratched.

Herein, the control unit 150 also supplies a predetermined voltage having an opposite polarity of the developer as the transfer bias voltage, such as +1 KV to +1.2 KV, to the second transfer roller 118*m* through the transfer bias voltage supply unit while the second and third portions 133*b* and 133*c* of the developer image 133 transferred on the non-image area are passing the nip between the second photoconductor 101*m* and image transfer belt 113. Due to the supplied bias voltage of +1 KV to +1.2 KV, an electric field of positive polarity is formed on the second and third portions 133*b* and 133*c* which will be reverse-transferred to the third and fourth photoconductors 101*c* and 101*y*. As a result, the second and the third portions 133*b* and 133*c* remain on the image transfer belt 113 without transferring to the second photoconductor 101*m*.

Since the image transfer belt 113 is continuously rotated in the direction A in FIG. 2, the second and third portions 133*b* and 133*c* of the developer image 133 reach at the nip between the third photoconductor 103*c* and the image transfer belt 113 as shown in FIG. 6C. Then, the control unit 150 controls the transfer bias voltage supply unit to interrupt voltage supply or to supply the transfer bias voltage of −1 KV to −1.2 KV to the third transfer roller 118*c*, as in the operation S7, while the first and second portions 133*a* and 133*b* of the developer image 133 are passing the nip between the third photoconductor 101*c* and the image transfer belt 113. Since the first portion 133*a* of the developer image 133 was already reverse-transferred to the second photoconductor 101*m* and cleaned in the operation S7, a small amount of the developer may be remaining on the first portion 133*a* after the cleaning in operation S7. As a result, the remaining developer in the first portion 133*a* and the second portion 133*b* of the developer image 133 are transferred to the third photoconductor 101*c* as shown in FIG. 6D in operation S11.

Since the third photoconductor 101*c* is continuously rotated, the remaining developer in the first portion 133*a* and the second portion 133*b* on the third photoconductor 101*c* are cleaned by the third photoconductor cleaning blade 106*c* and collected by the third photoconductor waste developer collector 125*c* in operation S12. Due to the remaining developer on the third photoconductor 101*c*, the edge of the third photoconductor cleaning blade 106*c* is not worn or damaged and the surface of the third photoconductor 101*c* is not scratched.

When the remaining developer of the first portion 133*a* and the second portion 133*b* of the developer image 133 are transferred, the third portion 133*c* remains on the image transfer belt 113. That is, the control unit 150 also supplies the transfer bias voltage of +1 KV to +1.2 KV to the third transfer roller 118*c* through the transfer bias voltage supply unit while the third portion 133*c* of the developer image 133 is passing the nip between the third photoconductor 101*c* and the image transfer belt 113. Due to the supplied bias voltage of +1 KV to +1.2 KV, an electric field of positive polarity is formed on the third portion 133*c* which will be reverse-transferred to the fourth photoconductor 101*y*. As a result, the third portion 133*c* remains on the image transfer belt 113 without transferring to the third photoconductor 101*c*.

If the third portion 133*c* of the developer image 133 reaches the nip between the fourth photoconductor 103*y* and the image transfer belt 113 as shown in FIG. 6D, the control unit 150 controls the transfer bias voltage supply unit to interrupt the voltage supply or to supply the transfer bias voltage of −1 KV to −1.2 KV to the fourth transfer roller 118*y* as in the operations S9 and S11 while the first and second portions 133*a* and 133*b*, which were reverse-transferred, and the third portion 133*c* of the developer image 133 are passing the nip between the forth photoconductor 101*y* and the image transfer belt 113. As a result, the remaining developer in the first and the second portions 133*a* and 133*b* and the third portion 133*b* of the developer image 133 are transferred to the fourth photoconductor 101*y* in operation S13.

Since the fourth photoconductor 101*y* is continuously rotated, the remaining developer in the first and the second portions 133*a* and 133*b* and the third portion 133*c* of the developer image 133 on the fourth photoconductor 101*y* are cleaned by the fourth photoconductor cleaning blade 106*y* and collected by the fourth photoconductor waste developer collector 125*y* in operation S14. Due to the remaining developer on the fourth photoconductor 101*y*, the edge of the fourth photoconductor cleaning blade 106*y* is not worn or damaged and the surface of the fourth photoconductor 101*y* is not scratched.

As described above, after the first, second and third portions 133*a*, 133*b* and 133*c* of the developer image 133 transferred on the non-image area of the image transfer belt 113 are reverse-transferred onto the second, third and fourth photoconductors 101*m*, 101*c* and 101*y*, the waste developer remaining on the image transfer belt 113 is cleaned by the belt cleaning blade 136 and collected by the belt waste developer collector 138 in operation S15 because the image transfer belt 113 is continuously rotated in the direction A.

Then, the control unit 150 determines whether or not data of a following page for printing is remaining in operation S16.

If there is data remaining for printing in the operation S116, the control unit 150 repeatedly performs the operations S3 through S15. Or, if there is no remaining data in the operation S16, the printing operation is terminated.

Embodiment 2

A tandem color image forming apparatus according to a second embodiment of the present invention is identical to the tandem color image forming apparatus 100 shown in FIG. 2, except for a control unit (not shown).

Accordingly, a drawing of the tandem color image forming apparatus according to a second embodiment of the present invention is not provided. Furthermore, detailed descriptions of the feeding unit 111, image forming unit 101, transfer unit 120, fusing unit 115, paper output unit 116 and cleaning unit 130 in the second embodiment are omitted.

The control unit according to the second embodiment is disposed at an upper portion of the main body M1 and includes a circuit board having a microprocessor electrically connected to the constitutional elements of the image forming apparatus 100 according to the second embodiment which is similar to the tandem color image forming apparatus 100 shown in FIG. 2.

In a mono color printing mode, the control unit according to the second embodiment controls each element of the image forming units 101 to form two developer images 132 and 133 on an image region of the first photoconductor 101*k* that performs an image forming process using the developer of black color as shown in FIGS. 6A through 6D. The developer image 132 is formed according to image signals inputted from a computer or a scanner. For the developer image 133, a plurality of horizontal lines are lengthily formed in a widthwise direction of the image forming belt 133, which is a lengthwise direction of the first photoconductor 101*k* for the lubrication of the photoconductor-cleaning blade. In the mono color printing mode, the control unit also controls a transfer-bias voltage supply unit (not shown) to supply the transfer-bias voltage to the first transfer roller 118*k* of the transfer unit 120 so that the developer images 132 and 133 formed on the image region of the first photoconductor 101*k* are transferred to an image forming area IA and to a non-image area UIA of the image transfer belt 113, respectively, while the image transfer belt 113 is conveying the image receiving mediums S. The non-image area UIA is an area of the image transfer belt 113 between two consecutive image receiving mediums S which are conveyed by the image transfer belt 113. Such an operation of the control unit according to the second embodiment is identical to the operation of the controller unit 150 in the color image forming apparatus 100 according to the first embodiment. Therefore, a detailed description thereof is omitted.

Furthermore, the control unit according to the second embodiment controls the transfer-bias voltage supply unit to supply a transfer-bias voltage to the second, third and fourth transfer rollers 118*m*, 118*c* and 118*y* to reverse-transfer the developer image 133 formed on the non-image area UIA of the image transfer belt 113 to the second, third and fourth photoconductors 101*m*, 101*c* and 101*y* which are not operated in the mono color printing mode. Accordingly, the lubrication between the second, third and fourth photoconductor-cleaning blades 106*m*, 106*c* and 106*y* and the second, third and fourth photoconductors 101*m*, 101*c* and 101*y* is improved. Such an operation of the control unit according to the second embodiment is identical to the operation of the controller unit 150 of the color image forming apparatus 100 according to the first embodiment. Therefore, a detailed description thereof is omitted.

In order to improve the lubrication between the second, third and fourth photoconductor-cleaning blades 106*m*, 106*c* and 106*y* and the second, third and fourth photoconductors 101*m*, 101*c* and 101*y* by forming developer images on the second, third and fourth photoconductors 101*m*, 101*c* and 101*y* which are not operated in the mono color printing mode, the control unit, according to the second embodiment, controls the second, third and fourth chargers 103*m*, 103*c* and 103*y* and the second, third and fourth development units 105*m*, 105*c* and 105*y* to form the developer image on the second, third and fourth photoconductors 101*m*, 101*c* and 101*y* without using the second, third and fourth laser scanning units 104*m*, 104*c* and 104*y*. That is, the second, third and fourth chargers 103*m*, 103*c* and 103*y* and the second, third and fourth development units 105*m*, 105*c* and 105*y* are used to form the developer image for improving the lubrication according to the second embodiment.

More specifically, while continuously supplying the charge bias voltage to the image regions of the second, third and fourth photoconductors 101*m*, 101*c* and 101*y*, the controller controls the charge bias voltage supply unit to interrupt the supply of the charge bias voltage at a predetermined portion of each of the image areas corresponding the non-image area of the image transfer belt 113. After the interruption, the controller controls the second, third and fourth erasing units 102*m*, 102*c* and 102*y* to erase the charge at the predetermined portion of each of the image regions 113. Therefore, the charge on the charge-erased portion of each of the image areas of the second, third and fourth photoconductors 101*m*, 101*c* and 111*y* becomes close to 0V which is much lower than adjacent areas that are at about −600V. As a result, an electric potential difference of about −250V is formed between the charge-erased portion of each of the image areas of the second, third and fourth photoconductors 101*m*, 101*c* and 101*y* and the second, third and fourth developer rollers 110*m*, 110*c* and 110*y* when the developer layer formed on the second, third and fourth developer rollers 110*m*, 110*c* and 110*y*, which receive −250V from the developing bias voltage supply unit, reaches the second, third and fourth photoconductors 101*m*, 101*c* and 101*y*. Accordingly, the charge-erased portion of each of the image areas of the second, third and fourth photoconductors 101*m*, 101*c* and 101*y* has an electric potential of positive polarity relative to the second, third and fourth developer rollers 110*m*, 110*c* and 110*y*. Due to the electric field generated by the electric potential difference, the developer 13 of the negative polarity is moved to the charge-erased portion of each of the image areas of the second, third and fourth photoconductors 101*m*, 101*c* and 101*y*. As a result, the charge-erased portion of each of the image areas of the second, third and fourth photoconductors 101*m*, 101*c* and 101*y* is polluted. The developer polluting the charge-erased portion is cleaned by the second, third and fourth photoconductor cleaning blades 106*m*, 106*c* and 106*y* and collected by the second, third and fourth photoconductor waste developer collectors 125*m*, 125*c* and 125*y* accordingly as the second, third and fourth photoconductors 101*m*, 101*c* and 101*y* are rotated in a counterclockwise direction. Therefore, the developer polluting the charge-erased portions protects the second, third and fourth photoconductor cleaning blades 106*m*, 106*c* and 106*y* to be damaged or worn which may be caused when the photoconductor cleaning blades 106*m*, 106*c* and 106*y* touch the photoconductors without the remaining developer. Also, the surfaces of the second, third and fourth photoconductors 101*m*, 101*c* and 101*y* are protected from being damaged by the developer polluting the charge-erased portions.

As another method of forming a developer image on the second, third and fourth photoconductors 101*m*, 101*c* and 101*y* without using the second, third and fourth laser scanning units 104*m*, 104*c* and 104*y* in the mono color printing mode, the control unit, according to the second embodiment, may control the charge bias voltage supply unit to supply a voltage having the opposite polarity of the developer, such as +2.2V, to the second, third and fourth transfer rollers 118*m*, 118*c* and 118*y* at the moment that the predetermined portion of each of the image areas of second, third and fourth photoconductors 101*m*, 101*c* and 101*y* corresponding to the non-image area UIA of the image transfer belt 113 passes the nip between the image transfer belt 113 and the second, third and fourth photoconductors 101*m*, 101*c* and 101*y* while interrupting the supply of the charge bias voltage to the second, third and fourth photoconductors 101*m*, 101*c* and 101*y*. Then, the electric potential of the predetermined portion of each of the image areas of the second, third and fourth photoconductors 101*m*, 101*c* and 101*y* is lower than the electric potential of the second, third and fourth developer rollers 110*m*, 110*c* and 110*y* by a voltage of +2.2 V transferred through the image transfer belt 113. Accordingly, a constant electric potential difference is formed between the predetermined portion of each of the image areas of the second, third and fourth photoconductors 101*m*, 101*c* and 101*y* and the second, third, and fourth developer rollers 110*m*, 10C and 110*y* when the developer layer formed on the second, third and fourth developer rollers 110*m*, 110*c* and 110*y* is transferred to the corresponding developing area of the second, third and fourth photoconductors 101*m*, 101*c* and 101*y*. Due to the electric field generated by the constant electric potential difference, the developer of a negative polarity is transferred to the predetermined portion of the image area of the second, third and fourth photoconductors 101*m*, 101*c* and 101*y*. As a result, the transferred developer pollutes the predetermined portion of each of the image areas of the second, third and fourth photoconductors 101*m*, 101*c* and 101*y*. Such a developer polluting the predetermined portions is cleaned by the second, third and fourth photoconductor cleaning blades 106*m*, 106*c* and 106*y* and collected by the second, third and fourth photoconductor waste developer collectors 125*m*, 125*c* and 125*y* when the second, third and fourth photoconductors 101*m*, 101*c* and 101*y* are rotated. Therefore, the developer polluting the predetermined portions protects the second, third and fourth photoconductor cleaning blades 106*m*, 106*c* and 106*y* from being damaged or worn which may be result when the photoconductor cleaning blades 106*m*, 106*c* and 106*y* touch the photoconductors without the remaining developer. Also, the surfaces of the second, third and fourth photoconductors 101*m*, 101*c* and 101*y* are protected from being damaged by the developer polluting the predetermined portion.

Figure 8:
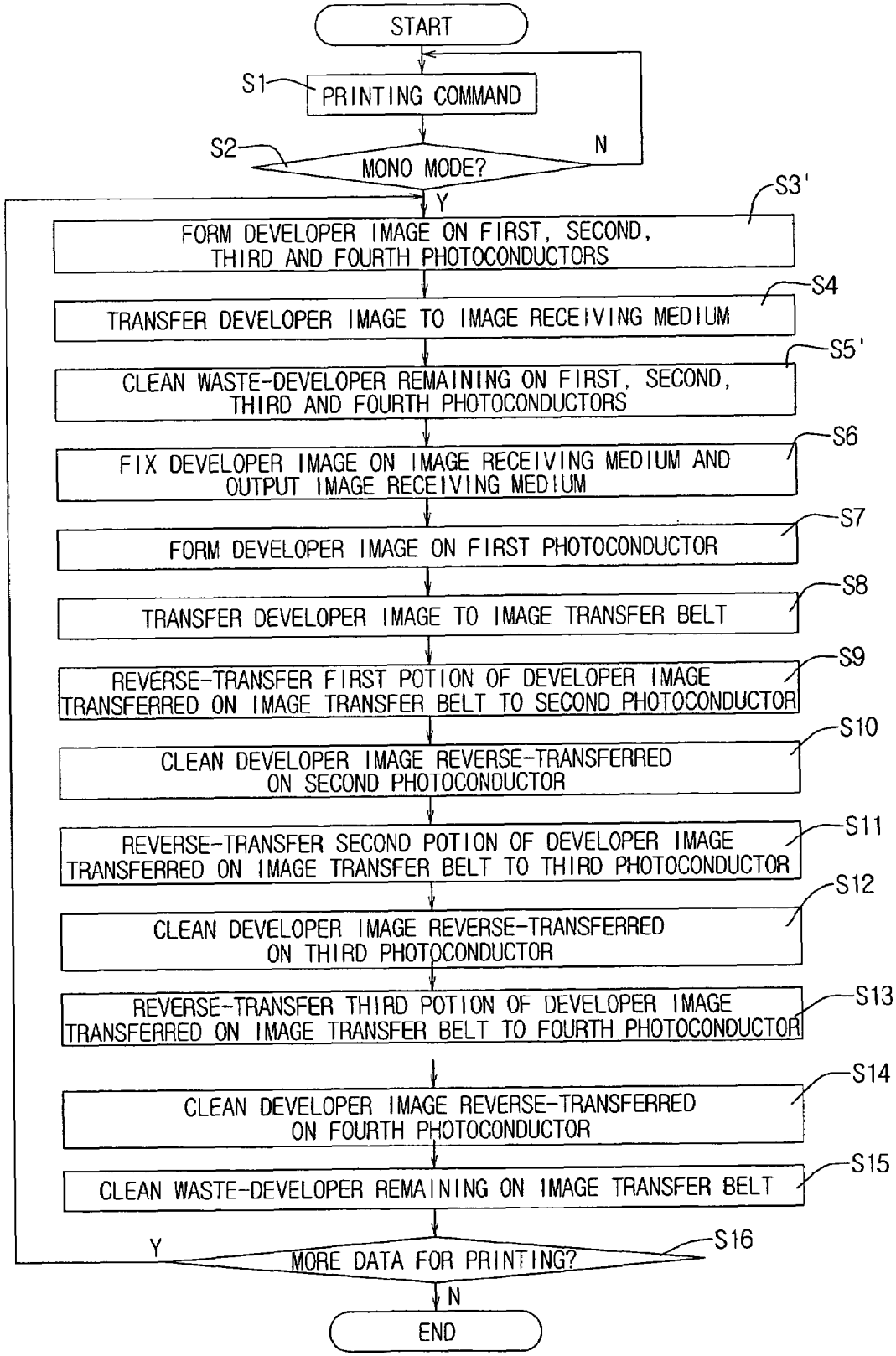
FIG. 8 is a flowchart showing a mono color printing method used in the tandem color image forming apparatus shown in FIG. 2 according to a second embodiment of the present invention.

Hereinafter, a mono color printing method of the tandem color image forming apparatus according to the second embodiment of the present invention will be described with reference to FIG. 8.

At first, if a printing command is inputted through a computer or a control panel in operation S1, the control unit determines whether or not a printing mode of the printing command is a mono color printing mode for forming images using only the black k developer in operation S2.

If the mono color printing mode was selected in operation S2, the control unit controls the image forming unit 101 including the first charger 103*k*, first laser scanning unit 104*k* and first development unit 105*k* to perform an image forming process that forms developer images 132 of black color k on an image region of the first photoconductor 101*k* corresponding to data of a first page.

The control unit also controls the second, third and fourth chargers 103*m*, 103*c* and 103*y* and the second, third and fourth developers 105*m*, 105*c* and 105*y* to form a developer image on a predetermined portion of each of the image areas of the second, third and fourth photoconductors 101*m*, 101*c* and 101*y* corresponding to the non-image area UIA of the image transfer belt 113 without using the second, third and fourth scanning units 104*m*, 104*c* and 104*y* in operation S3'.

Meanwhile, the image receiving medium S loaded in the paper cassette 111*a* is picked up by the pickup roller 112 and conveyed to the pressure roller 122 by the regist roller 114 at a predetermined time. Then, the image receiving medium S is conveyed to the nip between the image transfer belt 113 and the first photoconductor 101*k* by the pressure roller 122.

Accordingly, as the first photoconductor 101*k* is rotated in the counterclockwise direction by the gear train by receiving the force from the driving motor, the black developer image 132 of the first page's data, which is formed on the image region of the first photoconductor 101*k* corresponding to the image forming area IA of the image transfer belt 113, is transferred to the image forming medium S by the transfer bias voltage, such as +1 KV to +1.2 KV, that is supplied to the first transfer roller 118*k* from the transfer bias voltage supply unit in response to the control unit in operation S4.

In the operation S4, the control unit also controls the charging bias voltage supply unit to supply a charging bias voltage of a same polarity as a polarity of the current developer, such as −1 KV to −1.2 KV, to the second, third and fourth transfer rollers 118*m*, 118*c* and 118*y* when the developer formed on the predetermined portion of each of the image areas of the second, third and fourth photoconductors 101*m*, 101*c* and 101*y* reach the non-image area UIA of the image transfer belt 113. Therefore, the developer formed on the predetermined portion of each of the image areas of the second, third and fourth photoconductors 101*m*, 101*c* and 101*y* is not transferred to the non-image area UIA of the image transfer belt 113.

After transferring the developer image 132 from the first photoconductor 101*k* to the image receiving medium S conveyed by the image transfer belt 113, the remaining waste developer on the first photoconductor 101*k* is cleaned by the first photoconductor cleaning blade 106*k* and collected by the first photoconductor waste developer collector 125*k* accordingly as the first photoconductor 101*k* is rotated. Also, the developer formed on the predetermined portion of each of the image areas of the second, third and fourth photoconductors 101*m*, 101*c* and 101*y* is cleaned by the second, third and fourth photoconductor cleaning blades 106*m*, 106*c* and 106*y* and collected by the second, third and fourth photoconductor collectors 125*m*, 125*c* and 125*y* according as second, third and fourth photoconductors 101*m*, 101*c* and 101*y* being rotated in operation S5'.

Then, the control unit according to the second embodiment performs the operations S6 through S16 similar to the mono color printing method according to the first embodiment described with reference to FIG. 7, and then the printing operation is terminated.

Embodiment 3

A tandem color image forming apparatus according to a third embodiment of the present invention is identical to the tandem color image forming apparatus 100 shown in FIG. 2 except for a control unit (not shown).

Accordingly, the drawing of the tandem color image forming apparatus according to a third embodiment of the present invention is not accompanied. Furthermore, detailed descriptions of the feeding unit 111, image forming unit 101, transfer unit 120, fusing unit 115, paper output unit 116 and the cleaning unit 130 in the third embodiment are omitted.

The control unit according to the third embodiment is disposed at an upper portion of the main body M1 and includes a circuit board having a microprocessor electrically connected to the constitutional elements of the image forming apparatus according to the third embodiment similar to the tandem color image forming apparatus 100 shown in FIG. 2.

In a mono color printing mode, the control unit according to the third embodiment controls each element of the image forming units 101 to form a developer image 132 according to image signals inputted from a computer or a scanner on an image region of the first photoconductor 101*k* that performs an image forming process using the developer of black k color. The control unit also controls the transfer bias voltage supplied to the first transfer roller 118*k* of the transfer unit 120 through the charge bias voltage supply unit (not shown) so that the developer image 132 formed on the image area of the first photoconductor 101*k* is transferred to the image receiving medium S conveyed to the corresponding image forming area IA of the image transfer belt 113.

In order to improve the lubrication between the second, third and fourth photoconductor-cleaning blades 106*m*, 106*c* and 106*y* and the second, third and fourth photoconductors 101*m*, 101*c* and 101*y* through forming developer images on the second, third and fourth photoconductors 101*m*, 101*c* and 101*y* which are not operated in the mono color printing mode, the control unit forms a developer image on the second, third and fourth photoconductors 101*m*, 101*c* and 101*y* using the second, third and fourth chargers 103*m*, 103*c* and 103*y* and the second, third and fourth development units 105*m*, 105*c* and 105*y* without using the second, third and fourth scanning units 104*m*, 104*c* and 104*y*. Such an operation of the control unit according to the third embodiment is identical to the operation of the controller unit of the color image forming apparatus according to the second embodiment. Therefore, a detailed description thereof is omitted.

Figure 9:
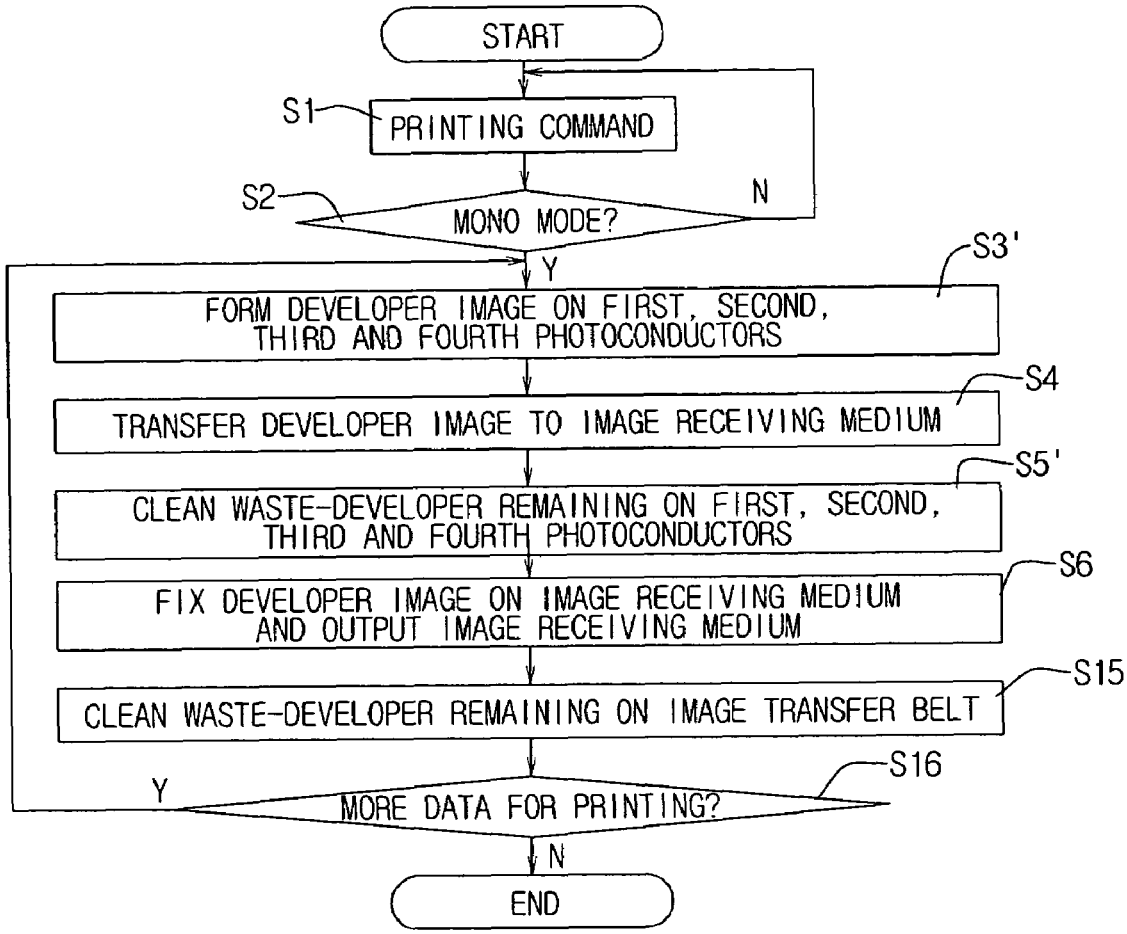
FIG. 9 is a flowchart showing a mono color printing method used in the tandem color image forming apparatus shown in FIG. 2 according to a third embodiment of the present invention.

Hereinafter, a mono color printing method of the tandem color image forming apparatus according to the third embodiment of the present invention will be described with reference to FIG. 9.

At first, if a printing command inputted through a computer or a control panel in operation S1, the control unit determines whether or not a printing mode of the printing command is a mono color printing mode for forming images using only the black k developer in operation S2.

If the printing command is the mono color printing mode in the operation S2, the control unit performs the operation S3' through S6 similar to the mono color printing method of the tandem color image forming apparatus according to the second embodiment described with reference to FIG. 8.

After performing the operation S6, the belt cleaning blade 136 cleans the pollutant on the image transfer belt 113 and the belt waste developer collector 138 collects the cleaned pollutant accordingly as the image transfer belt 113 is rotated in the direction A in operation S15.

Then, the control unit determines whether or not there is data of a next page to be printed in operation S16.

If there is another data in the operation S16, the control unit repeatedly performs the operations S3' through S6, and S15 and S16, and if not, the printing operation is terminated.

Embodiment 4

Figure 3:
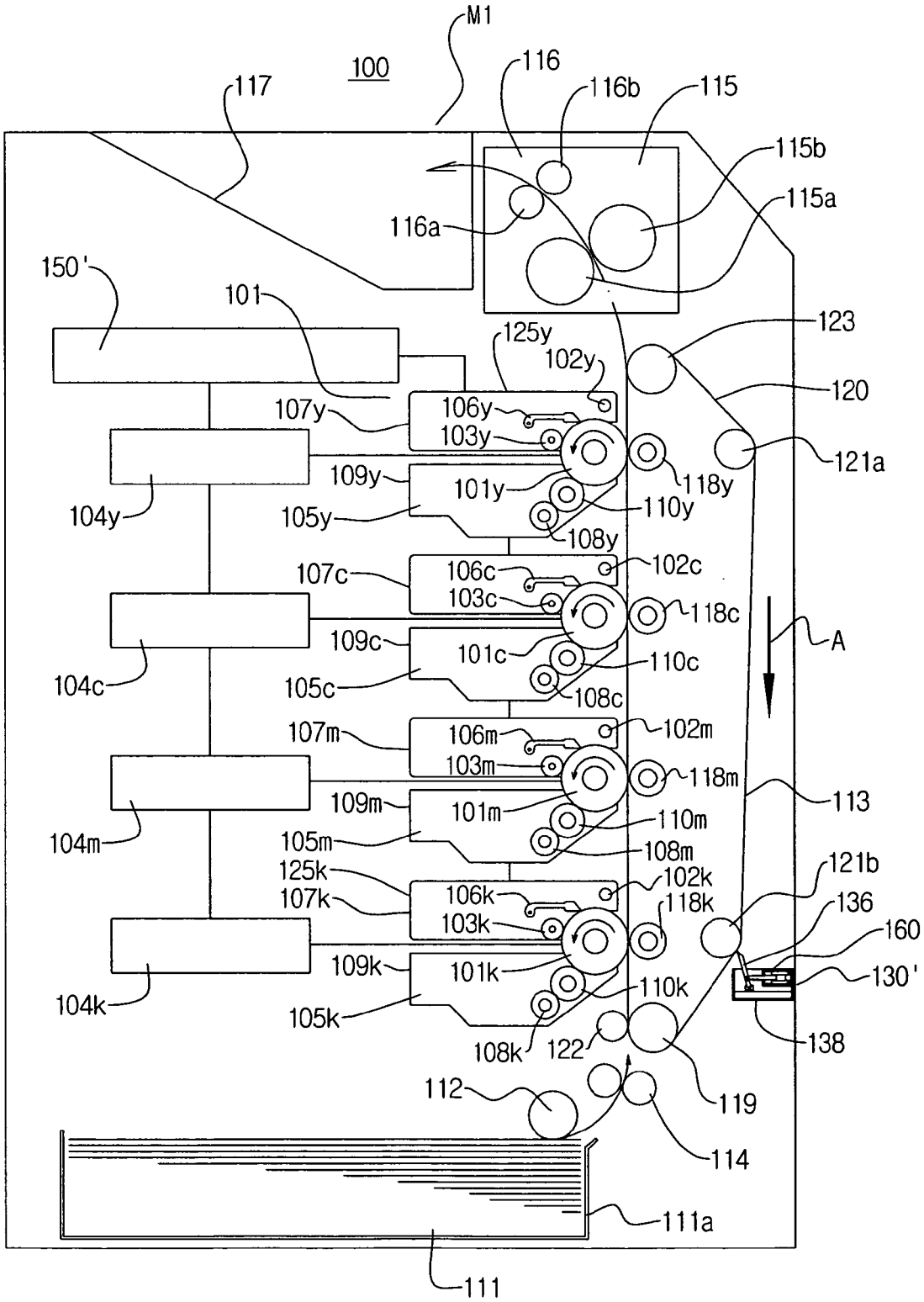
FIG. 3 is a schematic view of a tandem color image forming apparatus according to a fourth embodiments of the present invention.

FIG. 3 shows a tandem color image forming apparatus 100' according to the fourth embodiment of the present invention.

Referring to FIG. 3, the tandem color image forming apparatus 100' includes a feeding unit 111, an image forming unit 101, a transfer unit 120, a fusing unit 115, a paper output unit 116, a cleaning unit 130' and a control unit 150'.

The feeding unit 111, the image forming unit 101, the transfer unit 120, the fusing unit 115 and the paper output unit 116 are identical to those of the tandem color image forming apparatus 100 according to the first embodiment. Therefore, detail descriptions thereof are omitted.

The cleaning unit 130' includes a belt cleaning blade 136, a blade driving unit 160 and a belt waste developer collector 138.

Figure 4:
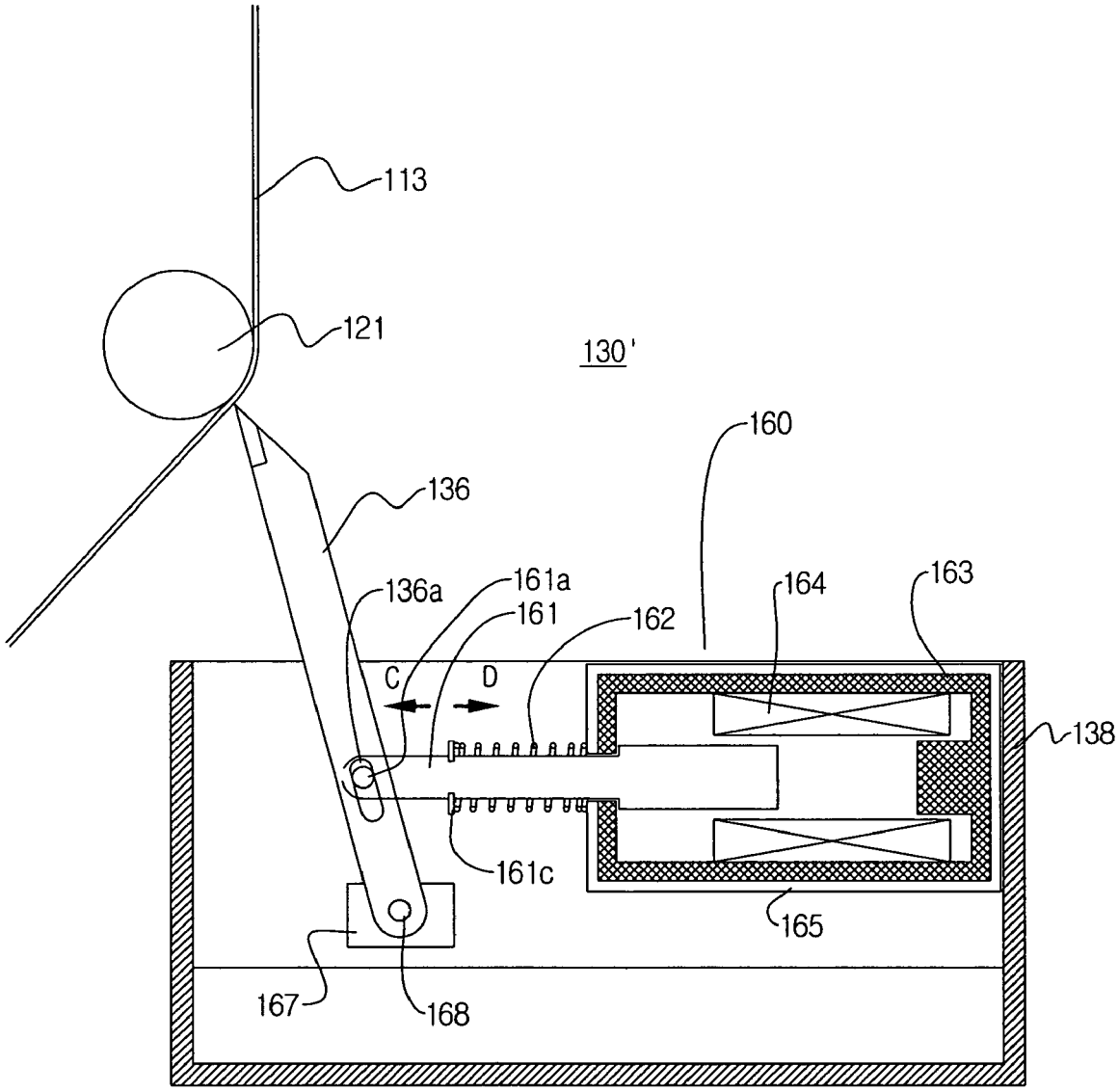
FIG. 4 is a cross-sectional view of a cleaning unit of the tandem color image forming apparatus shown in FIG. 3.

As shown in FIG. 4, the belt cleaning blade 136 removes waste-developer and pollutant remaining on the surface of the image transfer belt 113 after rotating one rotation cycle. The belt cleaning blade 136 is pivotally fixed at a shaft 168 disposed at a bracket 167 of the belt waste developer collector 138 so that the upper end of the belt cleaning blade 136 touches the image transfer belt 113 or is separated from the image transfer belt 113.

The blade driving unit 160 separates the belt cleaning blade 136 from the image transfer belt 113 in response to the controller 150' when a non-image area of the image transfer belt 113 is passed in the mono color printing mode. The blade driving unit 160 may be a solenoid connected to the belt cleaning blade 136.

As shown in FIG. 4, the solenoid includes a plunger 161, a coil 164, a plunger spring 162 and a case 165.

The plunger 161 is formed of metal or a magnet to be operated by magnetic force. The plunger 161 includes a connecting pin 161*a* formed on the upper portion of the plunger 161 and is slidably inserted into a hole 136*a* of the belt cleaning blade 136.

The coil 164 generates the magnetic force when the current is applied to the coil 164. The generated magnetic force of the coil 164 pulls the plunger 161 in a right direction D shown in FIG. 4. The coil 164 is supported by a yoke 163.

The plunger spring 162 pulls the plunger 161 in a left direction C to the original position when the current is not applied to the coil 164. The plunger spring 162 is disposed between a left side of the case 165 and a washer 161*c* of the plunger 161.

When the solenoid is turned on, that is, when the current is supplied to the coil 164, the plunger 161 is shifted to the right direction. As a result, the belt cleaning blade 136 is rotated about the shaft 168 in the counterclockwise direction. Therefore, the top end of the belt cleaning blade 136 is separated from the image transfer belt 136.

When the solenoid is turned off, that is, when the current is not supplied to the coil 164, the plunger 161 is shifted to the left direction by the plunger spring 162. As a result, the belt cleaning blade 136 is rotated about the shaft 168 in a clockwise direction. Therefore, the one end of the belt cleaning blade 136 touches the image transfer belt 113 to clean and to remove the waste developer and pollutant remaining on the image transfer belt 113.

Figure 5:
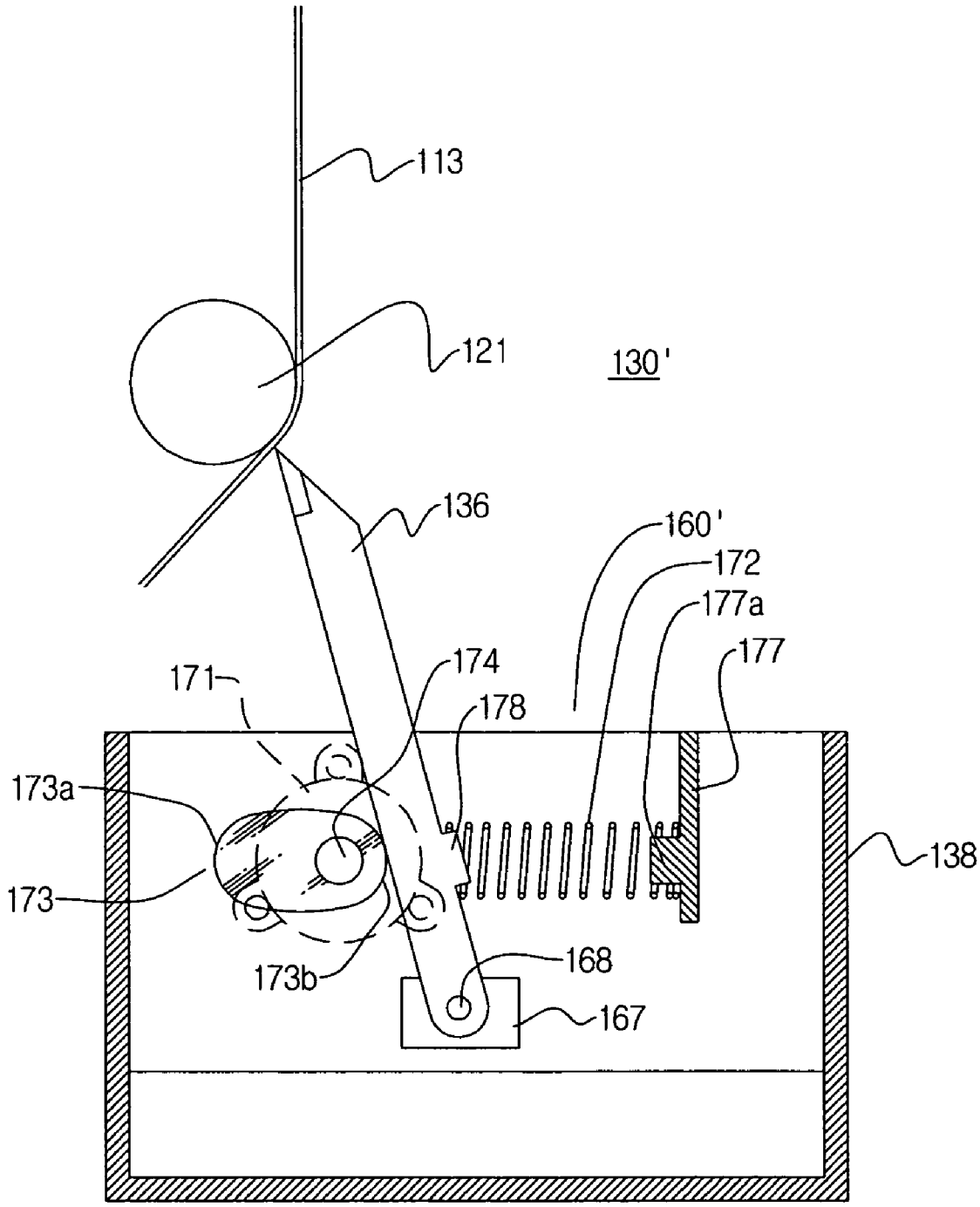
FIG. 5 is a cross-sectional view of other embodiment of a cleaning unit of the tandem color image forming apparatus shown in FIG. 3.

FIG. 5 shows a blade driving unit 160' according to another embodiment of the present invention.

The blade driving unit 160' includes a cam 173 having a first cam surface 173*a* and a second cam surface 173*b* touching the body of the belt cleaning blade 136.

A cam spring 172 elastically pressurizes the body of the belt cleaning blade 136 to touch the first and second cam surfaces 173*a* and 173*b*. The cam spring 172 is disposed between a first supporting member 178 formed on the body of the belt cleaning blade 136 and a second supporting member 177*a* of a bracket 177 of the belt waste developer collector 138. The cam 173 is fixed at a driving shaft 174 of a motor 171 and is driven by the motor 174.

When the driving shaft 174 of the motor 171 is rotated from the position shown in FIG. 5 to a predetermined direction, such as 180° in the clockwise direction, the first cam surface 173*a* touches the body of the belt cleaning blade 136 and the body of the belt cleaning blade 136 is rotated about the shaft 138 in the clockwise direction. That is, the cam 173 pushes the belt cleaning blade 136 to the cam spring 172. As a result, the top end of the belt cleaning blade 136 is separated from the image transfer belt 113.

On the contrary, the driving shaft 174 of the motor 171 is rotated from the 180° rotated position to other direction, such as 180° to the counterclockwise direction, the second cam surface 173*b* touches the body of the belt cleaning blade 136 as shown in FIG. 5 and the body of the belt cleaning blade 136 is rotated about the shaft 138 to the counterclockwise direction. That is, the belt cleaning blade 136 is returned to the original position. As a result, the one end of the belt cleaning blade 136 touches the image transfer belt 113 to clean the waste developer and the pollutant remaining on the image transfer belt 113.

The belt waste developer collector 138 collects and stores the waste developer and pollutant removed from the image transfer belt 113.

In a mono color printing mode, the control unit 150' controls each element of the image forming units 101 to form two developer images 132 and 133 on an image region of the first photoconductor 101*k* that performs an image forming process using the developer of black k color as shown in FIGS. 6A through 6D. The developer image 132 is formed corresponding to image signals inputted from a computer or a scanner. The developer image 133, a plurality of horizontal lines, is lengthily formed in a widthwise direction of the image forming belt 133, which is a lengthwise direction of the first photoconductor 101*k* for lubrication of the photoconductor-cleaning blade. In the mono color printing mode, the control unit 150' also controls a transfer-bias voltage supply unit (not shown) to supply the transfer-bias voltage to the first transfer roller 118*k* of the transfer unit 120 so that the developer images 132 and 133 formed on the image region of the first photoconductor 101*k* are transferred to an image forming area IA and to a non-image area UIA of the image transfer belt 113, respectively. Such an operation of the control unit 150' is identical to the operation of the control unit 150 of the color image forming apparatus 100 according to the first embodiment. Therefore, a detailed description thereof is omitted.

Furthermore, the control unit 150' controls the transfer-bias voltage supply unit to supply a transfer-bias voltage to the second, third and fourth transfer rollers 118*m*, 118*c* and 118*y* to reverse-transfer the developer image 133 formed on the non-image area UIA of the image transfer belt 133 to the second, the third and the fourth photoconductors 101*m*, 101*c* and 101*y* which are not operated in the mono color printing mode in order to improve the lubrication between the second, the third and the fourth photoconductor-cleaning blades 106*m*, 106*c* and 106*y* and the second, third and fourth photoconductors 101*m*, 101*c* and 101*y* is improved. Such an operation of the control unit 150' according to the fourth embodiment is identical to the operation of the controller unit 150 of the color image forming apparatus 100 according to the first embodiment. Therefore, the detailed description thereof is omitted.

Furthermore, the control unit 150' according to the fourth embodiment controls the blade driving unit 160 or 160' to separate the belt cleaning blade 136 from the image transfer belt 113 whenever the non-image area UIA of the image transfer belt 113 is passed so that the belt cleaning blade 136 and the belt waste developer collector 138 does not clean and collect the waste developer remaining on the non-image area of the image transfer belt 113 which is remaining after the developer image 133 on the non-image area of the image transfer belt 113 is reverse-transferred to the second, third and fourth photoconductors 101*m*, 101*c* and 101*y*. Generally, the developer of 90% to 95% is reverse-transferred from the image transfer belt 113 to the second, third and fourth photoconductors 101*m*, 101*c* and 101*y*. That is, the developer of 5% to 10% remains on the image transfer belt 113 after the reverse-transferring.

In this case, the waste developer on the image transfer belt 113, which is remaining after the developer image 133 on the non-image area of the image transfer belt 113 is reverse-transferred to the second, third and fourth photoconductors 101*m*, 101*c* and 101*y*, can be additionally reverse-transferred to the second, third and fourth photoconductors 101*m*, 101*c* and 101*y*, and then cleaned by the photoconductor cleaning blades 106*m*, 106*c* and 106*y* in a next rotation cycle of the image transfer belt 113. Therefore, the efficiency of using the developer for the lubrication of the second, third and fourth photoconductor-cleaning blades 106*m*, 106*c* and 106*y* is improved.

Figure 10:
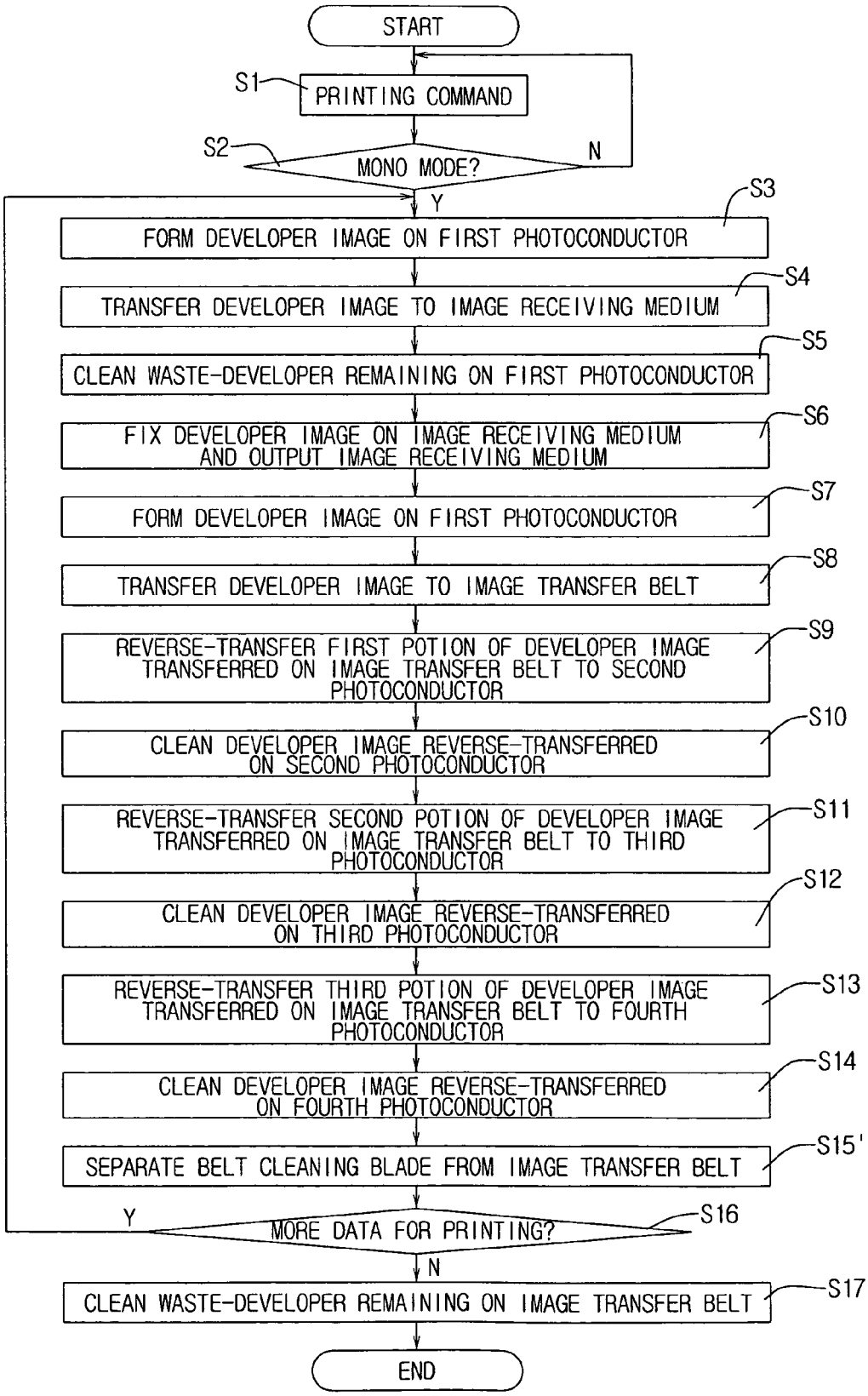
FIG. 10 is a flowchart showing a mono color printing method used in the tandem color image forming apparatus shown in FIG. 3 according to a fourth embodiment of the present invention.

Hereinafter, a mono color printing method of the tandem color image forming apparatus 100' according to the fourth embodiment will be described with reference to FIG. 10.

Figure 7:
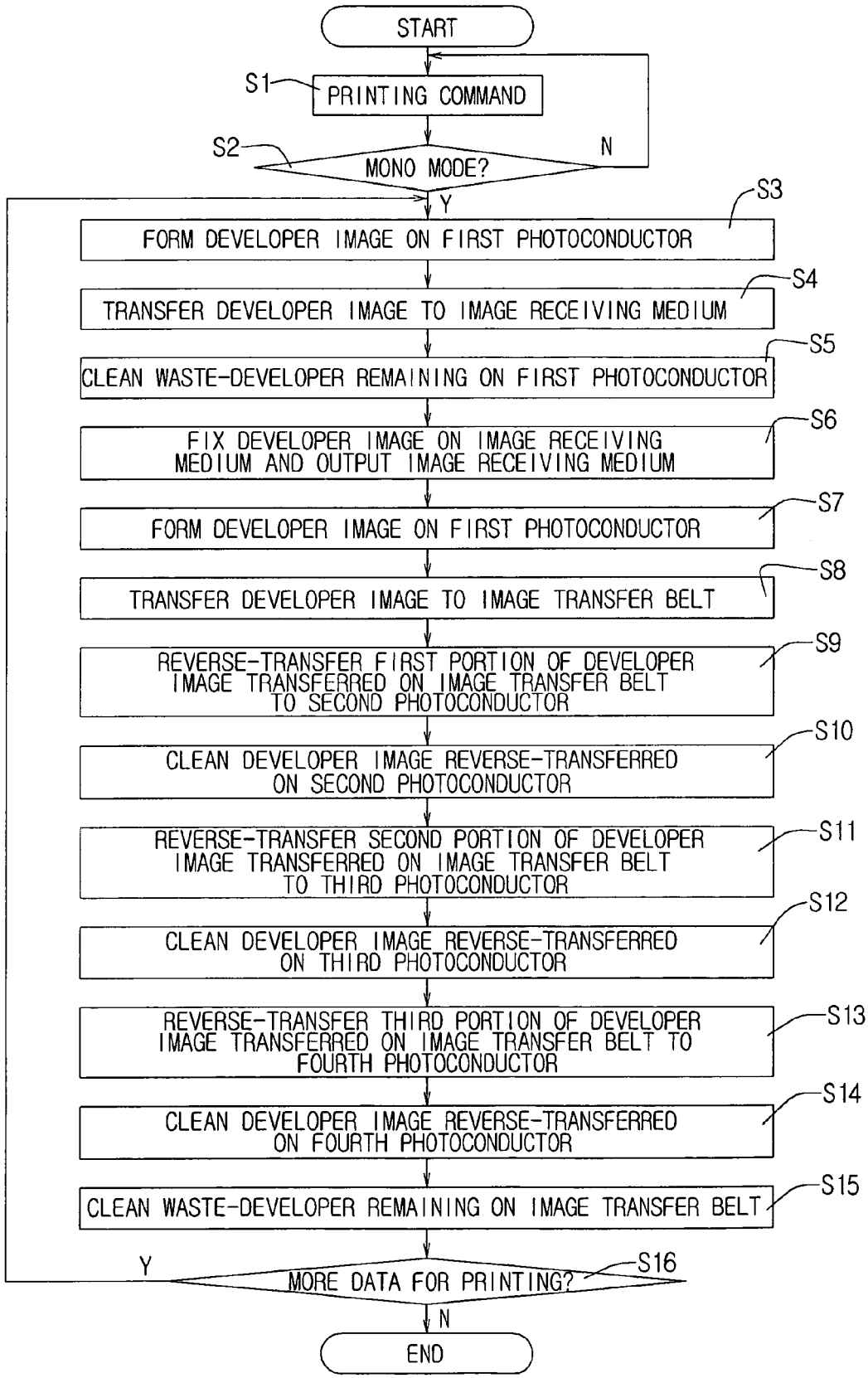
FIG. 7 is a flowchart showing a mono color printing method used in the tandem color image forming apparatus shown in FIG. 2 according to a first embodiment of the present invention.

At first, when a printing command in inputted through a computer or a control panel in operation S1, the control unit 150' performs the operations S1 through S14 as described in the mono color printing method of the tandem color image forming apparatus 100 according to the first embodiment with reference to FIG. 7.

In the operation S14, when the non-image area UIA of the image transfer belt 113 passes the belt cleaning blade 136 after cleaning and collecting the developer image reverse-transferred on the fourth photoconductor 101*y* by the fourth photoconductor cleaning blade 106*y*, the control unit 150' controls the blade driving unit 160 or 160' to separate the belt cleaning blade 136 from the image transfer belt 113 in operation S15' so that the non-image area UIA of the image transfer belt 113 is not cleaned by the belt cleaning blade 136. Herein, a time of separating the belt cleaning blade 136 from the image transfer belt 113 is determined as a time delayed by as much as a predetermined time from a time that a paper detecting sensor (not shown) is operated by a bottom edge of the image receiving medium S of the first page, wherein the paper detecting sensor is disposed between the regist roller 114 and the pressure roller 122. The operating start time of the paper detecting sensor is also determined as a starting point of the non-image area UIA. The delay time is determined as a duration from the time of detecting the starting point of the non-image area UIA to a time that the starting point of the UIA reaches the belt cleaning blade 136. Also, a duration of separating the belt cleaning blade 136 from the image transfer belt 113 is determined from a time that the paper detecting sensor is operated by the bottom edge of the image receiving medium S of the first page to a time that the paper detecting sensor is operated by the top edge of the image receiving medium S of the next page.

Then, the control unit 150' determines whether or not there is data for a next page to be printed in operation S16.

If there is the data of the next page in the operation S16, the control unit 150' repeatedly performs the operations S1 through S15'. If not, in the operation S17, the control unit 150' controls the driving roller 123 by a driving motor to rotate the image transfer belt 113 one rotation cycle more. As a result, the waste developer and the pollutant remaining on the non-image area UIA of the image transfer belt 113 is cleaned and removed by the belt cleaning blade 136 and collected by the belt waste developer collector 138.

As described above, the color image forming apparatus and the mono color printing method according to an exemplary embodiment of the present invention supplies the developer image on the photoconductors which do not perform the image forming process in the mono color printing mode. Accordingly, the lubrication between the photoconductors and the cleaning units is improved, and the photoconductors and the cleaning units are protected from being damaged and scratched. Therefore, the color image forming apparatus and the mono color printing method according to an exemplary embodiment of the present invention prevents the degradation of the image quality caused by the damaged cleaning units and the scratched photoconductors.

While the invention has been shown and described with reference to certain embodiments thereof, it will be understood by those skilled in the art that various changes in form and details may be made therein without departing from the spirit and scope of the invention as defined by the appended claims.

What is claimed is:

1. A color image forming apparatus capable of performing a mono color printing mode for forming an image using a developer of one color, comprising:

a plurality of photoconductors;

a charger for charging each of the photoconductors;

a development unit for forming a developer image on each of the photoconductors;

a transfer unit including an image transfer member for receiving the developer image from each of the photoconductors and a transfer voltage supply member for supplying a transfer bias voltage to the image transfer member;

a first cleaning unit for cleaning each of the photoconductors; and a control unit for controlling the photoconductors, charger, development unit and transfer unit in a mono color printing mode to form a developer image on an image area of a selected one of the plurality of photoconductors, to transfer the formed developer image to a non-image area of the image transfer member, and to divide the transferred developer image into portions and reverse-transfer the divided portions of the transferred developer image from the image transfer member to remaining photoconductors.

2. The color image forming apparatus of claim 1, wherein when the divided portions of the transferred developer image come in contact with remaining photoconductors assigned to be reverse-transferred thereto, respectively, the control unit controls the transfer voltage supply member to supply a voltage of a certain level having a same polarity as a developer or controls the transfer voltage supply member not to supply any voltages to the image transfer member in contact with the remaining photoconductors.

3. The color image forming apparatus of claim 2, wherein the control unit controls the transfer voltage supply member to supply a voltage of a certain level having a different polarity from a developer to the image transfer member in contact with the remaining photoconductors when the divided portions of the transferred developer image come in contact with remaining photoconductors assigned not to be reverse-transferred thereto, respectively.

4. The color image forming apparatus of claim 1, wherein the control unit controls the charger not to supply a charge bias voltage to a first portion of an image area of each of the remaining photoconductors while the charger continuously supplies the charge bias voltage to each of the remaining photoconductors, where the first portion is a portion of the image area corresponding to the non-image area of the image transfer member.

5. The color image forming apparatus of claim 4, further comprising an erasing unit erasing an electric potential charged at the photoconductors, wherein the control unit controls the erasing unit to erase an electric potential charged at the first portion on each of the remaining photoconductors.

6. The color image forming apparatus of claim 5, wherein when the developer image formed on the first portion on each of the remaining photoconductors comes in contact with the non-image area of the image transfer member, the control unit controls the transfer voltage supply member to supply a voltage of a certain level having a same polarity as a developer to the image transfer member being in contact with each remaining photoconductor so as not to transfer the developer image formed on the first portion on each of the remaining photoconductors to the image transfer member.

7. The color image forming apparatus of claim 1, wherein when a first portion of the image area of each remaining photoconductor comes in contact with the non-image area of the image transfer member after the control unit controls the charger not to supply a charge bias voltage to the first portion of each of the remaining photoconductors, the control unit controls the transfer voltage supply member to supply a voltage of a certain level having a difference polarity from a developer to the image transfer member where the first portion is a portion of the image area corresponding to the non-image area of the image transfer member in contact with each remaining photoconductor.

8. The color image forming apparatus of claim 7, wherein, when developer images formed on the first portions of the remaining photoconductors come in contact with the non-image area of the image transfer member after the developer images are formed on the first portions of the remaining photoconductors, the control unit controls the transfer voltage supply member to supply a transfer bias voltage of a certain level having a same polarity as a developer to the image transfer member in contact with each remaining photoconductor.

9. The color image forming apparatus of claim 1, further comprising a second cleaning unit cleaning a waster-developer and pollutant remaining on the image transfer member.

10. The color image forming apparatus of claim 9, wherein the first cleaning unit includes a plurality of photoconductor cleaning blades disposed to touch each of the photoconductors; and the second cleaning unit includes one of a belt cleaning blade having one end un-movably fixed to touch the image transfer member and a belt cleaning blade having one end pivotally fixed so as to touch the image transfer member or to be separated from the image transfer member.

11. The color image forming apparatus of claim 10, wherein the belt cleaning blade includes one end pivotally fixed to touch the image transfer unit or to be separated from the image transfer unit; and the second cleaning unit further includes a blade driving unit connected to the belt cleaning blade for separating the belt cleaning blade from the image transfer member when the non-image area of the image transfer member is passed in the mono color printing mode.

12. The color image forming apparatus of claim 11, wherein the blade driving unit includes a solenoid connected to the belt cleaning blade.

13. The color image forming apparatus of claim 12, wherein the solenoid includes:

a plunger connected to the belt cleaning blade;

a coil for shifting the plunger by generating a magnetic force when current is supplied; and an elastic spring for pushing the plunger back to an original position when the coil does not generate the magnetic force.

14. The color image forming apparatus of claim 11, wherein the blade driving unit includes:

a cam for touching the belt cleaning blade; and an elastic spring for elastically pressurizing the belt cleaning blade to touch the cam.

15. A color image forming apparatus capable of performing a mono color printing mode for forming an image using a developer of one color, comprising:

a plurality of photoconductors;

a charger for charging each of the photoconductors;

a development unit for forming a developer image on each of the photoconductors;

a transfer unit including an image transfer member for receiving the developer image formed on each of the photoconductors;

a first cleaning unit for cleaning each of the photoconductors;

a second cleaning unit for cleaning the image transfer member; and a control unit for controlling the photoconductors, charger and transfer unit in a mono color printing mode to form developer images on an image area of a selected one of the plurality of photoconductors and image areas of remaining photoconductors to transfer the developer image formed on the selected photoconductor to an image receiving medium conveyed by the image transfer belt, and not to transfer the developer image formed on the image areas of the remaining photoconductors to the image receiving medium;

wherein the control unit controls the charger not to supply a charge bias voltage to a first portion of the image area on each of the remaining photoconductors while continuously supplying the charge bias voltage to each of the remaining photoconductors, where the first portion is a portion of the image area corresponding to an non-image area of the image transfer member.

16. The color image forming apparatus of claim 15, further comprising an erasing unit erasing electric potential charged at the photoconductors, wherein the control unit controls the erasing unit to an erase electric potential charged at the first portions of the remaining photoconductors.

17. The color image forming apparatus of claim 16, wherein when developer images formed on the first portions of the remaining photoconductors touch the non-image area of the image transfer member, the control unit controls a transfer voltage supply member to supply a voltage of a certain level having a same polarity as a developer to the image transfer member in contact with each remaining photoconductor.

18. A color image forming apparatus capable of performing a mono color printing mode for forming an image using a developer of one color, comprising:

a plurality of photoconductors;

a charger for charging each of the photoconductors;

a development unit for forming a developer image on each of the photoconductors;

a transfer unit including an image transfer member for receiving the developer image formed on each of the photoconductors;

a first cleaning unit for cleaning each of the photoconductors;

a second cleaning unit for cleaning the image transfer member; and a control unit for controlling the photoconductors, charger and transfer unit in a mono color printing mode to form developer images on an image area of a selected one of the plurality of photoconductors and image areas of remaining photoconductors to transfer the developer image formed on the selected photoconductor to an image receiving medium conveyed by the image transfer belt, and not to transfer the developer image formed on the image areas of the remaining photoconductors to the image receiving medium;

wherein when first portions of the remaining photoconductors touch a non-image area of the image transfer member after the control unit controls the charger not to supply a charge bias voltage to the first portions of the remaining photoconductors, the control unit controls the transfer voltage supply member to supply a voltage of a certain level having a different polarity from a developer to the image transfer member in contact with the remaining photoconductor, where the first portions are portions of the image area corresponding to the non-image area of the image transfer member.

19. The color image forming apparatus of claim 18, wherein when the developer images formed on the first portions of the remaining photoconductors touch the non-image area of the image transfer member after the developer images are formed on the first portions of the remaining photoconductors, the control unit controls the transfer voltage supply member to supply a voltage of a certain level having a same polarity as a developer to the image transfer member in contact with the remaining photoconductors so as not to transfer developer images formed on the first portions of the remaining photoconductors to the image transfer member.

20. A color image forming apparatus capable of performing a mono color printing mode for forming an image using a developer of one color, comprising:

a plurality of photoconductors;

a charger for charging each of the photoconductors;

a development unit for developing a developer image on each of the photoconductors;

a transfer unit including an image transfer member for receiving the developer image formed on each of the photoconductors;

a first cleaning unit for cleaning each of the photoconductors;

a second cleaning unit disposed to touch the image transfer member or to be separated from the image transfer member for cleaning the image transfer member; and a driving unit connected to the second cleaning unit for separating the second cleaning unit from the image transfer member when the second cleaning unit passes a non-image area of the image transfer member in the mono color printing mode.

21. The color image forming apparatus of claim 20, wherein the second cleaning unit includes a belt cleaning blade having one end pivotally fixed.

22. The color image forming apparatus of claim 21, wherein the driving unit includes a solenoid connected to the belt cleaning blade.

23. The color image forming apparatus of claim 22, wherein the solenoid includes:

a plunger connected to the belt cleaning blade;

a coil for shifting the plunger through generating a magnetic force when a current is supplied; and an elastic spring for returning the plunger to an original position when the coil does not generate the magnetic force.

24. The color image forming apparatus of claim 21, wherein the driving unit includes:

a cam for touching the belt cleaning blade; and an elastic spring for elastically pressurizing the belt cleaning blade to be in contact with the cam.

25. A mono color printing method of a color image forming apparatus, forming an image using a developer of one color, the mono color printing method comprising:

forming a developer image on one photoconductor;

transferring the developer image formed on the one photoconductor to an image transfer member;

dividing the developer image transferred on the image transfer member into portions and reverse-transferring the divided portions of the transferred developer image from the image transfer member to remaining photoconductors which do not perform the image forming process; and cleaning the reverse-transferred developer image on each of the color photoconductors.

26. The mono color printing method of claim 25, wherein the forming of the developer image includes:

forming a developer image on a second portion of an image area on the one photoconductor, where the second portion is a portion of the image area corresponding to an image area of the image transfer member conveying the image receiving medium; and forming a developer image on a first portion of the image area of the one photoconductor, where the first portion is a portion of the image area corresponding to a non-image area of the image transfer member.

27. The mono color printing method of claim 26, wherein the transferring of the developer image to the image transfer member includes:

transferring the developer image formed on the second portion of the image area on the one photoconductor to the image receiving medium conveyed by the image transfer member; and transferring the developer image formed on the first portion of the image area on the one photoconductor to the non-image area of the image transfer member.

28. The mono color printing method of claim 27, wherein the dividing and reverse-transferring of the developer image includes:

supplying a voltage of a certain level having a same polarity of a developer or not supplying any voltages to the image transfer member in contact with remaining photoconductors when the divided portions of the developer image transferred on the non-image area of the image transfer member touch the remaining photoconductors which are assigned to be reverse-transferred thereto, respectively; and supplying a voltage of a certain level having a polarity different from a developer to the image transfer member in contact with remaining photoconductors when the divided portions of the developer image transferred on the non-image area of the image transfer member touch the remaining photoconductors assigned not to be reverse-transferred thereto, respectively.

29. The mono color printing method of claim 26, further comprising:

controlling not to clean the image transfer member when the non-image area of the image transfer member is passed; and cleaning the image transfer member to remove a developer image and pollutant remaining on the image transfer member after an image forming operation is terminated.

30. The mono color printing method of claim 25, further comprising:

forming the developer image on each of the remaining photoconductors; and controlling not to transfer the developer image formed on each of the remaining photoconductors to the image transfer member.

31. The mono color printing method of claim 30, wherein the forming of the developer image on each of the remaining photoconductors includes controlling not to supply a charge bias voltage to first portions of the image areas of the remaining photoconductors while continuously supplying the charge bias voltage to each of the remaining photoconductors, where the first portion of the image area of each of the remaining photoconductors is a portion of the image area of each of the remaining photoconductors corresponding to a non-image area of the image transfer member.

32. The mono color printing method of claim 31, wherein the forming of the developer image on each of the remaining photoconductors further includes erasing an electric potential charged at the first portion of the image area in each of the remaining photoconductors.

33. The mono color printing method of claim 30, wherein the forming of the developer image on each of the remaining photoconductors includes supplying a voltage of a certain level having a polarity different from a developer to the image transfer member in contact with the remaining photoconductors when first portions of the remaining photoconductors touch the image transfer member after not supplying the charge bias voltage to the first portions of the remaining photoconductors.

34. The mono color printing method of claim 30, wherein the controlling so as not to transfer the developer image includes supplying a voltage of a certain level having a same polarity as a developer to the image transfer member in contact with the remaining photoconductors not to transfer the developer image to the image transfer member when the developer image formed on first portions of the remaining photoconductors touch a non-image area of the image transfer member.

35. The mono color printing method of claim 25, further comprising cleaning the image transfer member to remove developer image and pollutant remaining on the image transfer member.

36. A mono color printing method of a color image forming apparatus for forming an image using a developer of one color, comprising:

forming a developer image on one photoconductor;

transferring the developer image formed on the one photoconductor to an image transfer member;

forming a developer image on remaining photoconductors that do not perform the image forming process;

controlling so as not to transfer the developer image formed on each of the remaining photoconductors to the image transfer member; and cleaning the developer image remaining on the one photoconductor and the developer image formed on each of the remaining photoconductors after transferring the developer image to the image transfer member;

wherein the forming of the developer image on each of the remaining photoconductors includes controlling not to supply a charge bias voltage to a first portion of an image area in each of the remaining photoconductors while continuously supplying the charge bias voltage to each of the remaining photoconductors, where the first portion is a portion of the image area corresponding to a non-image area of the image transfer member.

37. The mono color printing method of claim 36, wherein the forming of the developer image on each of the remaining photoconductors further includes erasing electric potential charged at the first portion of the image area in each of the remaining photoconductors.

38. A mono color printing method of a color image forming apparatus for forming an image using a developer of one color, comprising:

forming a developer image on one photoconductor;

transferring the developer image formed on the one photoconductor to an image transfer member;

forming a developer image on remaining photoconductors that do not perform the image forming process;

controlling so as not to transfer the developer image formed on each of the remaining photoconductors to the image transfer member; and cleaning the developer image remaining on the one photoconductor and the developer image formed on each of the remaining photoconductors after transferring the developer image to the image transfer member;

wherein the forming of the developer image on each of the remaining photoconductors includes supplying a voltage of a certain level having a polarity different from a developer to the image transfer member in contact with the remaining photoconductors when a first portion of an image area in each of the remaining photoconductors touches the image transfer member after controlling not to supply the charge bias voltage to the first portion of the image area in each of the remaining photoconductors, where the first potion is a portion of the image area corresponding to a non-image area of the image transfer member.

39. A mono color printing method of a color image forming apparatus for forming an image using a developer of one color, comprising:

forming a developer image on one photoconductor;

transferring the developer image formed on the one photoconductor to an image transfer member;

forming a developer image on remaining photoconductors that do not perform the image forming process;

controlling so as not to transfer the developer image formed on each of the remaining photoconductors to the image transfer member; and cleaning the developer image remaining on the one photoconductor and the developer image formed on each of the remaining photoconductors after transferring the developer image to the image transfer member;

wherein the controlling so as not to transfer includes supplying a voltage of a certain level having a same polarity as a developer to the image transfer member in contact with the remaining photoconductors when the developer image formed on a portion of an image area in each of the remaining photoconductors touches the non-image area of the image transfer member so as not to transfer the developer image to the image transfer member.

* * * * *